US012195993B2

(12) United States Patent
Richards et al.

(10) Patent No.: US 12,195,993 B2
(45) Date of Patent: Jan. 14, 2025

(54) POOL AND SPA SHELLS AND METHODS OF MANUFACTURE

(71) Applicant: Latham Pool Products, Inc., Latham, NY (US)

(72) Inventors: Thom P. Richards, Jane Lew, WV (US); William Frank Gately, Lakeland, FL (US); Alexander Joseph Mitchell, Wesley Chapel, FL (US); Richard E. Black, Jr., Huntsville, AL (US)

(73) Assignee: Latham Pool Products, Inc., Latham, NY (US)

( * ) Notice: Subject to any disclaimer, the term of this patent is extended or adjusted under 35 U.S.C. 154(b) by 25 days.

(21) Appl. No.: 17/954,197

(22) Filed: Sep. 27, 2022

(65) Prior Publication Data

US 2023/0097825 A1 Mar. 30, 2023

Related U.S. Application Data

(60) Provisional application No. 63/249,438, filed on Sep. 28, 2021.

(51) Int. Cl.
*E04H 4/00* (2006.01)

(52) U.S. Cl.
CPC ... *E04H 4/0031* (2013.01); *E04H 2004/0068* (2013.01)

(58) Field of Classification Search
CPC ..... E04H 4/0037; E04H 2004/0068
USPC ..... 4/506
See application file for complete search history.

(56) References Cited

U.S. PATENT DOCUMENTS

| | | | |
|---|---|---|---|
| 3,016,546 | A | 1/1962 | Lerner |
| 3,208,084 | A | 9/1965 | Collins et al. |
| 3,374,491 | A | 3/1968 | Patin et al. |
| 3,668,715 | A | 6/1972 | Chase |
| 3,962,734 | A | 6/1976 | Chase |

(Continued)

FOREIGN PATENT DOCUMENTS

| | | | |
|---|---|---|---|
| AU | 2019210529 | A1 | 8/2019 |
| AU | 2020101856 | A4 | 9/2020 |

(Continued)

OTHER PUBLICATIONS

EP Application EP22198058.4 , "Extended European Search Report", Feb. 9, 2023, 7 pages.

(Continued)

*Primary Examiner* — Huyen D Le
(74) *Attorney, Agent, or Firm* — Kilpatrick Townsend & Stockton LLP

(57) ABSTRACT

A pool shell comprising a pool shell body including an angled feature, wherein the angled feature defines an open region on an underside of the pool shell body. The pool shell may further comprise an insert positioned in the open region for providing structural support to the angled feature. The pool shell may further comprise an overlaying member positioned over the open region such that the insert is positioned between the underside of the pool shell body and the overlaying member, wherein the overlaying member is a substantially flat material for defining an exterior ramp surface extending over the open region defined by the angled feature.

20 Claims, 16 Drawing Sheets

(56) References Cited

U.S. PATENT DOCUMENTS

| | | | | |
|---|---|---|---|---|
| 4,343,120 | A * | 8/1982 | Witte | E04H 4/144 52/19 |
| 4,873,802 | A * | 10/1989 | Dahowski | E04H 4/144 52/746.1 |
| 5,752,350 | A | 5/1998 | Maiuccoro | |
| 5,794,391 | A | 8/1998 | Howard | |
| 6,655,098 | B2 * | 12/2003 | Dillen, II | E04F 21/26 52/182 |
| 8,857,115 | B2 | 10/2014 | Epple | |
| 10,358,837 | B2 | 7/2019 | Khamis et al. | |
| 10,450,766 | B2 | 10/2019 | Khamis et al. | |
| 10,472,839 | B2 | 11/2019 | Khamis et al. | |
| 2006/0162063 | A1 | 7/2006 | Weissenecker | |
| 2013/0014321 | A1 | 1/2013 | Sullivan | |

FOREIGN PATENT DOCUMENTS

| | | | |
|---|---|---|---|
| BR | 102015028242 | A2 | 5/2017 |
| CA | 3042190 | A1 | 11/2019 |
| DE | 19829167 | A1 | 1/2000 |
| FR | 2690191 | A1 | 10/1993 |
| FR | 2737240 | B1 | 10/1997 |
| FR | 2785928 | | 5/2000 |
| FR | 2919882 | B1 | 10/2009 |
| FR | 2950914 | B1 | 11/2011 |
| FR | 3017637 | B1 | 9/2016 |
| WO | 2020034006 | A1 | 2/2020 |

OTHER PUBLICATIONS

Get Peace of Mind. Ask Your Dealer About the Backfill Eliminator®, Backfill Eliminator®—Thursday Pools, Available online at https://thursdaypools.com/innovations/backfill-eliminator/, Accessed from Internet on Aug. 22, 2023, pp. 1-3.

EP Application No. EP 22198058.4 Examination Report, dated Oct. 28, 2024, 4 pages.

* cited by examiner

POOL AND SPA SHELLS AND METHODS OF MANUFACTURE

CROSS-REFERENCES TO RELATED APPLICATIONS

The present application claims priority from, and is a nonprovisional application of, U.S. Provisional Application No. 63/249,438, entitled "Pool Shell and Methods of Manufacture" filed Sep. 28, 2021, the entire contents of which are herein incorporated by reference for all purposes.

FIELD OF THE INVENTION

This application relates generally to pool and spa shells, and more particularly, although not necessarily exclusively, to reinforcement components for the pool and spa shells.

BACKGROUND OF THE INVENTION

Prefabricated or preformed pool and spa shells (including lap pools, swimming pools, hot tubs, spas, and the like) can be advantageous over in-situ formed or concrete walled pools and spas, for example, by allowing for quick and inexpensive manufacturing of the shell away from the installation location. According to current methods, fiberglass pool, hot tub, or spa shells (herein after referred to as "pool shells," which includes fiberglass shells for pools, hot tubs, spas, and the like) are made on a mold away from the installation location. The resulting pool shell is then shipped to an installation location where a hole is dug that corresponds to the shape of the fiberglass pool shell. During the installation process, the pool shell is backfilled with backfill material (e.g., dirt/gravel), which act to support the pool shell. The backfilling process is an important part of the pool shell installation process. If the backfill process is performed unsuccessfully, void spaces on the exterior of the pool shell may allow the shell to bend or flex outward, particularly when the interior volume pool shell is filled with water. Such bending and flexing may result in cracks or damage to the shell, which may cause leaks in the pool as well as a poor aesthetic appearance.

The process of backfilling is time consuming and costly (both in labor and materials), especially for spaces or radiuses beneath certain features of the pool shell, such as steps, tanning ledges, safety ledges, courtesy ledges, benches. During the backfill process, these spaces or radiused regions (hereinafter referred to as "angled features") that require backfilling are susceptible to damage to the shell when not backfilled properly. For example, steps, tanning ledges, safety ledges, courtesy ledges, benches, and the like, which may form spaces or radiused regions on the underside of the pool shell requiring backfilling, can be susceptible to damage if installed with poor backfill support. Moreover, backfilling such angled features is particularly difficult. For example, because these angled features are on the underside, or near the underside, of the shell, it may be more difficult and time-consuming for a laborer to reach these angled features once the pool shell is lowered into the hole.

Further, pool shell installations, including backfilling, are usually performed by general labor workers, who may not have the specific knowledge and expertise in general construction or pool installation required to properly backfill these regions. Therefore, not only do these angled features require particular attention to properly backfill such that the risk of damage to the pool shell is minimized, improper backfilling can result in later damage to a pool shell upon filling and use. Moreover, once the damage is sustained, the pool shell cannot be easily fixed or repaired. In addition, it can be dangerous for installers to access these angled features, in some instances requiring installers to position themselves between an elevated pool shell and the ground, which could cause significant injury to the installer if the pool shell were to inadvertently lower.

Further, no matter how precise the backfill process is, there likely always be some portions of the angled features that are not supported by the backfill either due to a poor backfill or as the backfill material settles over time, leaving the pool shell susceptible to damage.

Accordingly, reducing the cost of installation of a pool shell and/or reducing the difficulty of installation of a pool shell, and/or increasing the safety of installing the pool shell is desirable.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Successfully backfilling features of the pool shell (herein after referring to a pool shell, a hot tub shell, a spa shell, and the like) can be especially difficult for spaces or radiused regions defined by angled features along the underside regions of the pool shell corresponding to tanning ledges, steps, and the like. Other areas which have interior angles which protrude into the interior volume of the pool shell may also present backfill difficulties, for example, but not limited to, safety ledges, courtesy ledges, benches, or any other features that create a space or radiused region that requires backfilling for proper support during and after installation. In addition, positioning backfill in these angled features can be dangerous for installers as accessing the angled features can at times require an installer to position their body between the pool shell and the ground, which could cause significant injury to the installer if the pool shell were to be inadvertently lowered. Further, the backfill process is rarely guaranteed to succeed in providing support to every portion of the angled features. According to aspects of the present disclosure, a pool shell may include additional reinforcement components adjacent the features corresponding to angled features on the underside of the pool shell to improve the ease of installation, reduce installation costs, reduce risk of installer injury during installation, and improve the quality of the installation thereby.

One aspect of the disclosure provides for a pool shell. The pool shell may comprise: a pool shell body including an angled feature, wherein the angled feature defines an open region on an underside of the pool shell body; an insert positioned in the open region for providing structural support to the angled feature; and an overlaying member positioned over the open region such that the insert is positioned between the underside of the pool shell body and the overlaying member, wherein the overlaying member is a substantially flat material for defining an exterior ramp surface extending over the open region defined by the angled feature. The pool shell may further comprise a stiffener component positioned between the pool shell body and the insert. The insert may comprise a foam material. The overlaying member may comprise at least one of a fiberglass composite material, a high-density foamcore material, a urethane foam material, or a carbon fiber material. The pool shell may further comprise a reinforcement layer applied between the insert and the overlaying member for aiding in securing the insert to the pool shell body. The reinforcement layer may comprise a reinforcement spray. The reinforcement spray may include a resin material and a fiberglass material. The angled feature may include a first edge and a second edge and the overlaying member may extend from the first edge of the angled feature to the second edge of the angled feature for enclosing the open region on the underside of the pool shell body defined by the angled feature. The pool shell includes a tread and riser and the first edge of the angled feature corresponds to a first end of the tread and the second edge of the angled feature corresponds to a first end of the riser. The pool shell may further comprise a cover positioned on an outer surface of the overlaying member. The cover may be a fabric material. The fabric material may comprise fiberglass.

Another aspect of the disclosure provides for a method of manufacturing a pool shell. The method may comprise the steps of: providing a fiberglass pool shell having an angled feature defining an open region on an underside of the fiberglass pool shell; positioning an insert in the open region defined by the angled feature; positioning an overlaying member over the insert; and applying a reinforcement layer over the overlaying member for securing the overlaying member to the fiberglass pool shell, wherein the overlaying member defines a ramped surface that encloses at least a portion of the open region. The method may further comprise positioning a stiffener component to at least a portion of the angled feature prior to positioning the insert in the open region defined by the angled feature, wherein the stiffener component comprises a fiberglass material. The method may further comprise positioning an additional insert in an additional open region on the underside of the fiberglass pool shell defined by an additional angled feature of the fiberglass pool shell. The overlaying member may cover the open region and the additional open region defined by the angled feature and the additional angled feature of the fiberglass pool shell. The method may further comprise positioning an additional overlaying member over the additional open region defined by the additional angled feature of the fiberglass pool shell. The method may further comprise applying a reinforcement layer over the insert for securing the insert in the open region. The reinforcement layer may comprise at least one of a resin or a fiberglass material. The method may further comprise applying a cover over the overlaying member, wherein the cover is a fabric material comprising a fiberglass material.

BRIEF DESCRIPTION OF THE DRAWINGS

A further understanding of the nature and advantages of various embodiments may be realized by reference to the following figures. In the appended figures, similar components or features may have the same reference label.

DETAILED DESCRIPTION

Figure 1:
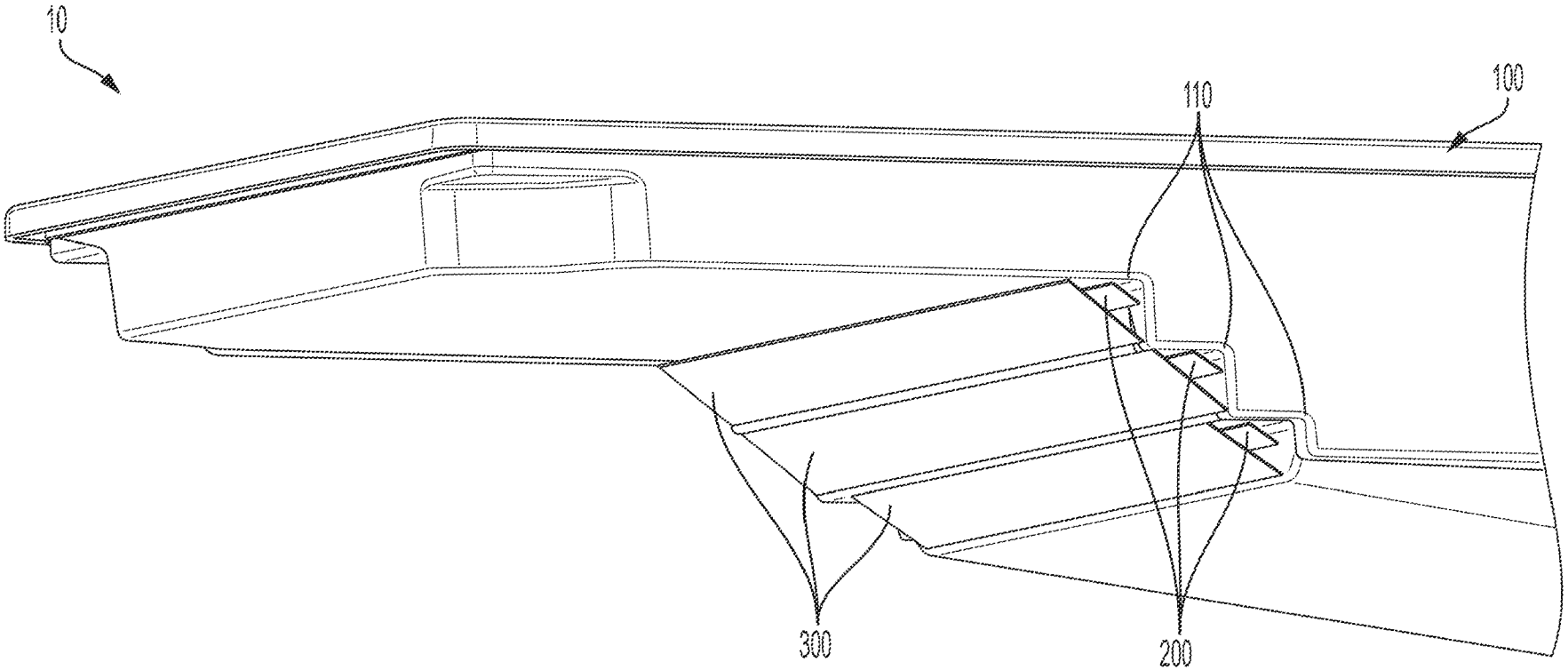
FIG. 1 is a lower perspective schematic of a pool shell including reinforcement components according to certain embodiments of the present disclosure.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "upper," "lower," "down," "top," "left," "right," "bottom," among others, are not intended to be limiting and are instead intended to refer to the orientation as illustrated and described in the figure (or figures) to which the components and directions are referencing.

Various features for reducing the complexity and cost of backfilling pool shells (hereinafter "pool shells" refers to pool shells, spa shells, hot tub shells, and the like) during installation, improving the installation process, and reducing risks to installers during installation are discussed herein. Specifically, during manufacturing of a pool shell, features may be added to the pool shell to provide for support of various features of the pool shell such that the shell does not crack or bend upon installation, filling, and use. According to aspects of the present disclosure, such features may include reinforcement components that are added to the pool shell during manufacturing to provide for a reduction in the angled features of the pool shell and which facilitate a reduction in the amount of backfilling performed during installation. Additionally, these reinforcement components provide support to all the portions of the angled features, which is not feasible with current backfill procedures.

Such reinforcement may be included on the underside of the pool shell adjacent the various angled features of a pool shell design. These angled features may correspond to angular or rounded features along an underside of the pool shell that define spaces that create an uneven (or non-planar) exterior surface along the pool shell. For example, angular features may include tanning ledges, courtesy ledges, steps, benches, safety ledges, or other features interior features of the pool shell which may correspond to open regions on the underside of the pool shell that may require backfilling. Rounded features may include rounded channels, benches, beach entries, indents, corners, or the like.

While the angled features discussed herein correspond to interior features of a pool shell having rectangular (linear) angles and defining spaces, it is contemplated that similar reinforcement components may be utilized to improve the installation process related to spaces created on the underside of the pool shell corresponding to rounded features, such as round or oval shaped steps, benches, and other rounded interior features of a pool shell.

FIG. 1 depicts an example pool shell 10 including a pool shell body 100 having an exterior surface that defines a number of angled features 110. Although FIG. 1 depicts the angled features 110 as steps, it is understood that the angled features 110 may be other angular or rounded features, as described above. The pool shell 10 may include one or more reinforcement components to provide structure and support to the angled features 110. The reinforcement components may include inserts 200, overlaying members 300, and other reinforcing layers. Such reinforcement components may assist in simplifying the backfilling process for the pool shell 10 by minimizing the open space on the underside of the pool shell body 100 defined by the angled features 110 and reducing the volume of the underside of the pool shell 10 that requires backfilling. As shown in FIG. 1, the reinforcement components, described in further detail below, may provide for a planar surface (in other words a substantially flat surface, though the surface may be angled with respect to the underside of the pool shell and/or the ground into which the pool shell is installed) extending across the open regions defined by the angled features 110. In some aspects, the planar surface defined by the reinforcement components may have a consistent angle and/or substantially continuous surface, as shown in FIG. 1, while in other aspects, the reinforcement components may form more than one planar surface at varying angles, for example as shown in the embodiment depicted in FIG. 13. Without the reinforcement components, the open regions on the underside of the pool shell body 100 defined by the angled features 110 require backfill material to be positioned deep within each of the angled corners defined by the risers and treads of the stair features (e.g., the angled features 110). Those open regions defined by the angled features 110 may be difficult to reach and may further be difficult to adequately backfill. As shown in FIG. 1, the reinforcement components, in some embodiments, may provide for a planar surface that extend along the length of adjacent angled features, providing a generally flat or planar surface that has fewer and/or less deep open regions, which may provide for an easier backfilling process.

Additionally, these reinforcement components may provide support to the angled feature 110 which may reduce the chances of the pool shell 10 cracking or breaking after installation, filling, and use. The reinforcement components may provide more support to the pool shell 10 than a backfill process alone, thereby reducing the likelihood of the pool shell 10 cracking, breaking, or otherwise becoming damaged. In some aspects, some or all the reinforcement components may also provide sound deafening benefits for reducing sounds produced when the angled features are stepped on during use, after installation.

As will be discussed further below, the inserts 200 may be seated within the open regions defined by the angled features 110 to provide structural support to the angled features 110. The inserts 200 may thereby aid in "filling" the open regions and may provide support to the overlaying members 300. The overlaying members 300 may be overlaid over the inserts 200 and may provide additional support to the angled features 110 and protection to the inserts 200. The overlaying members 300 may also define a planar surface extending along at least a portion of the length of the adjacent angled features 110 for reducing the volume of the open regions of the angled features 110 requiring backfill and reducing the number of corners into which backfill material must be positioned. Thus, the inserts 200 and overlaying members 300 may provide structural support to the angled features 110 and may minimize the amount of backfill required to support the angled features 110. The overlaying members 300 also provides an exterior surface that minimizes the complexity and cost of backfilling by smoothing out the angled features of the pool shell 100 and reducing the overall exposed surface area of the pool shell 100. As described further below, the reinforcement components may include additional features.

FIGS. 2-7 depict the assembly of the pool shell 10 according to one embodiment of the disclosure. With specific reference to FIG. 2, the pool shell 10 may have a pool shell body 100 having an outer surface coated with a gel coat. The gel coat may in some embodiments be covered with a base coat. The base coat may be made from vinyl ester resin or other similar material to protect the gel coat from various chemical issues associated with fiberglass pools, such as osmotic blisters. In other alternative embodiments, the outer surface of the pool shell body 100 may be covered with only one of a gel coat or base coat. Alternatively, the outer surface of the pool shell body 100 may be covered with no coat of material once it is removed from the mold.

According to embodiments of the present disclosure, an additional reinforcement layer may further cover the base coat. The reinforcement layer may be, for example but not limited to, a reinforcement spray 400 be between about 100 and 120 mils thick once applied and cured. However, in other embodiments, there may be other ranges of thickness of the reinforcement spray 400, such as 50-100 mils or 120-200 mils. Such measurements may additionally be applicable when or if the reinforcement spray 400 is applied along the pool shell 100 at a later stage in the process.

The reinforcement spray 400 may include a fiberglass chop material and/or a resin material that may be sprayed and subsequently rolled out to the desired thickness. This rolling process may be performed, for example, with a fiberglass laminating roller or rib roller. The fiberglass chop material may be mixed with resin and applied across the exterior surface of the pool shell. However, in other embodiments, a reinforcement layer may be used that is not sprayed on. The reinforcement spray 400 may include any other material that provides strength and protective qualities to the pool shell body 100.

Figure 2:
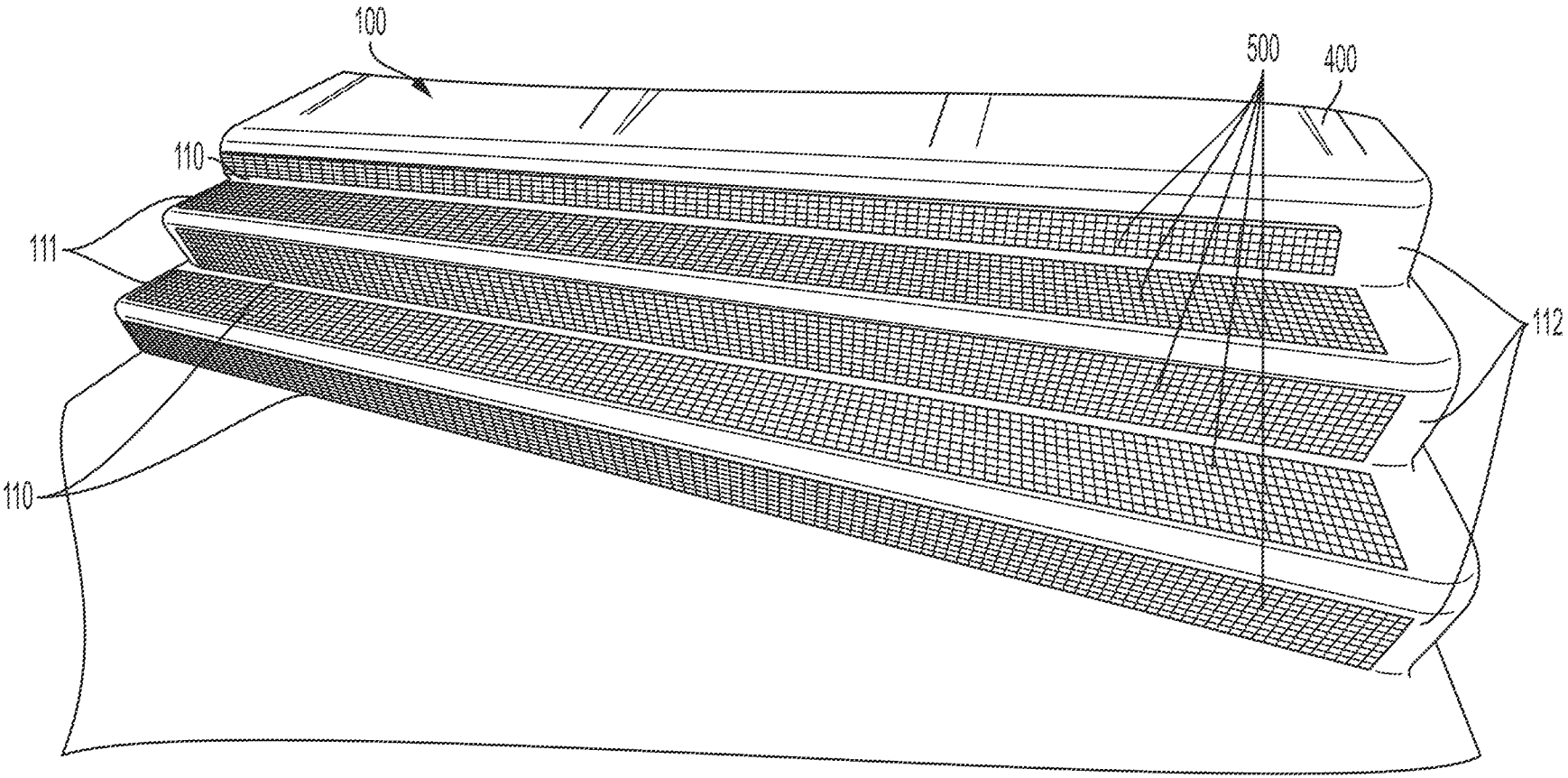
FIG. 2 is an upper perspective view of a stiffener component being installed on an underside of a pool shell body according to another embodiment of the present disclosure.

As shown in FIG. 2, in some aspects of the present disclosure, one or more stiffener components 500 may be provided on at least one of the flat (or substantially planar) sections of the angled features 110. For example, as shown in FIG. 2, stiffener components 500 are provided on the risers 112 and the treads 111 of the steps of the pool shell body 100, where the steps correspond to the angled features 110 of the pool shell body 100. The risers 112 and treads 111 may together define an open region (or space) 113 and interior angle 114 therebetween. Risers 112 are the substantially vertical sections of the angled features 110 and the treads 111 are the substantially horizontal sections of the angled features 110.

The stiffener components 500 may be provided on at least one of the risers 112 or treads 111 to provide support to the angled features 110. The stiffener components 500 may be secured to the pool shell body 100 by the adhesive quality of the reinforcement spray 400. For example, the stiffener components 500 may be applied on the treads 111 and risers 112 while the reinforcement spray 400 is wet to adhere the stiffener components 500 to the reinforcement spray 400. However, in other embodiments, it may be preferable to apply the stiffener components 500 after the reinforcement spray 400 is dried. In still yet other embodiments, no reinforcement layer may be used and the stiffener components 500 may be secured to the pool shell body 100 via other coupling means including but not limited to alternative adhesives, mechanical fasteners, or other suitable means.

In various aspects, the stiffener components 500 may be a planar material, such as a sheet of material. In this configuration, the sheets of material may be dimensioned appropriately to fit the treads 111 or risers 112 on which they are to be attached. The sheets may be of a thin material, such as being ¼ inch thick or thinner. In other variations, the sheets may vary in thickness, for example, but not limited to, from about ¼ inch to about ¾ inch. The stiffener components 500 may have a honeycomb structure (e.g., Nida-Core™) or other structure providing reinforcement to the pool shell 100. Materials may be contemplated which balance needs of low cost, low weight, and high strength. For example, fiberglass composite materials, high-density foam-core, plasticore, finolex, urethane foam, blackboard, or carbon fiber may be used. In various aspects, the stiffener components 500 may be made from other materials, including wood (such as plywood), various plastics or polymers, or metal (such as aluminum sheeting).

In some aspects, the stiffener components 500 may also provide sound-deafening/deadening and hardness/solidness qualities to the steps or other angled features of the pool shell. For example, after installation, during use, the step (defined by the risers 112 and treads 111) may sound hollow when stepped on. As such, these stiffener components 500 may also provide sound-deafening/deadening to the steps (or other angled features) to give the pool shell body 100 a solid sound and feeling when ultimately installed. For example, the stiffener components 500 may include a polyester resin-filled core material. This material may be particularly beneficial where the reinforcement spray 400 is a polyester material because one polyester material being engaged to another polyester material forms a stiffness that provides greater structural support than other materials. A non-limiting example of a material that provides sound-deafening and structurally supporting qualities, while also providing structural support to the angled features 110, includes Ameri-Core™.

Following the placement of stiffener components 500 on one or more areas of the angled features 110, an additional reinforcement layer (e.g. reinforcement spray 400 or other suitable reinforcement layer) may be positioned on top of the stiffener components 500 to secure the stiffener components 500 to the pool shell body 100 and to provide additional strength. For example, the reinforcement spray 400 may be a spray comprising a resin mixed with fiberglass chop, and may be applied to partially or completely cover the stiffener components 500. The reinforcement spray 400 may be rolled out after application and, when rolled out, it may be about 90 mils in thickness. However, in other embodiments, there may be other ranges of thickness of the reinforcement spray 400 such as 50-90 mils or 90-180 mils. In other embodiments, a reinforcement layer may be used that is not a spray.

Figure 3:
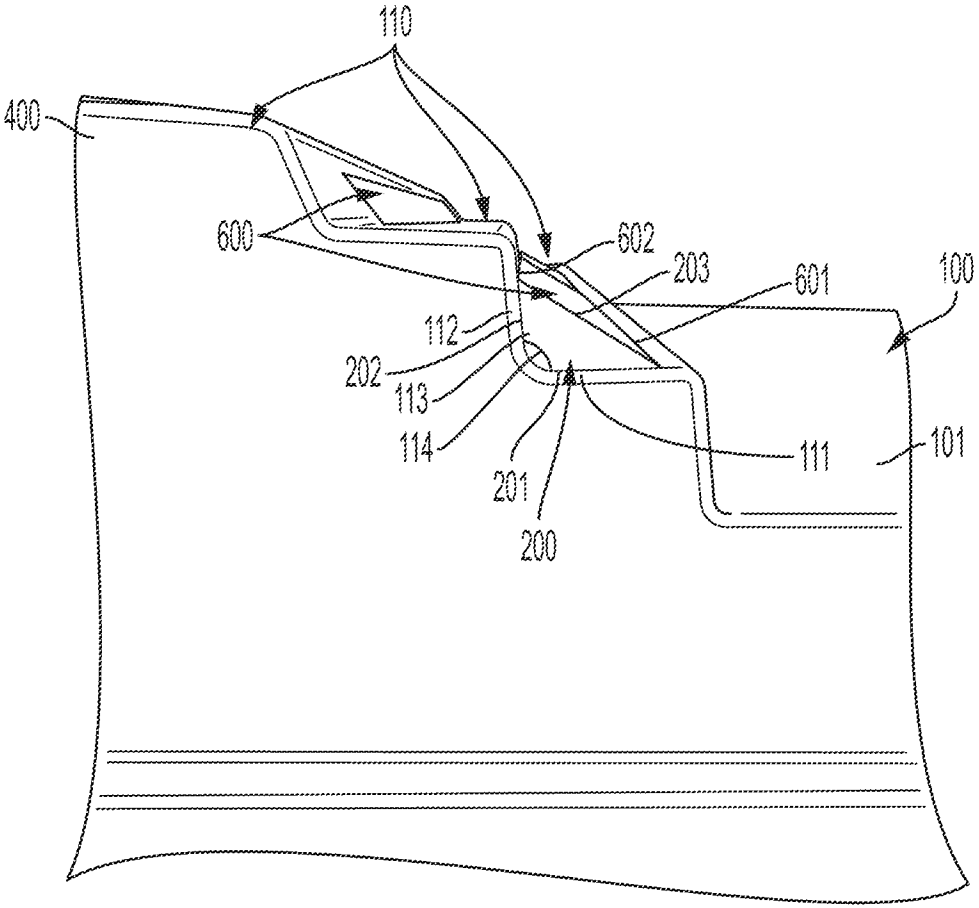
FIG. 3 is a side perspective view of an insert and covers being installed on the underside of the pool shell body of FIG. 2.

As shown in FIG. 3, after the application of the additional reinforcement spray 400, one or more inserts 200 may be positioned at the juncture of the risers 112 and treads 111 to fill in part of the open regions between the risers 112 and treads 111 (or open regions defined at least in part by angled features 110). The inserts 200 may be received within the open regions defined by the angled features 110 while the reinforcement spray 400 is still wet for increased adhesion of the inserts 200. However, in other embodiments, the insert 200 may be applied after the reinforcement spray 400 has dried. Specifically, the inserts 200 may be received in the space 113 to provide structural support to the angled features 110. In particular, where the angled features 110 are steps, the inserts 200 may provide direct support to the risers 112 and treads 111. The inserts 200 may additionally occupy a portion of the space 113 such that the inserts 200 closes off certain areas from requiring backfilling.

In some aspects, the inserts 200 may be sized and shaped to fit within at least a portion of the spaces 113 along the interior angle 114 of the angled feature 110 being supported. For example, FIG. 3 depicts where the insert 200 may include a first surface 202 attached to the riser 112 and a second surface 201 attached to the treads 111 with an exterior-facing ramp surface 203. As shown, where the angled feature 110 is a step or ledge, the insert 200 may be shaped as a triangular prismoid. In this manner, similar to a gusset, the insert 200 may completely occupy the space 113 along the interior angle 114 of the angled feature 110 such that the insert 200 lies flush against the angled feature 110. In other words, in some embodiments there are substantially no gaps between the insert 200 and the angled feature 110 such that substantially the entire area of the surfaces 201,202 are respectively in contact with the treads 111 and risers 112. Additionally, the triangular prismoid shape may provide a substantially planar ramp surface 203 so that other reinforcement components may be stably laid atop this surface.

In other embodiments, the inserts 200 may have other shapes. For example, the inserts 200 may be a thin, planar structure which provides strength reinforcement to the interior angle of the space but would still leave a gap between the insert 200 and the interior angle 114 of the angled feature 110. In this example, the insert 200 may have beveled or tapered edges angled such that the edges would lie flush/aligned against the corresponding tread 111 or riser 112. This may be beneficial if another reinforcement component may be supplied within that gap. In a further alternative, the insert 200 may be an alternative prismoid shape. For example, the insert 200 may be a quarter cylinder shape such that the ramp surface 203 is curved. This may be beneficial where the ground surrounding the pool shell body 100 is soft and the curved ramp surface 203 can push out the surrounding ground to minimize the space formed between each angled feature 110.

The inserts 200 may be made from various materials that provide structural support to the angled features 110. Examples of such materials include plastic or polymer materials, such as a corrugated plastic material (e.g., plasticore) or may be made from a wood (e.g., plywood), fiberglass (e.g., a fiberglass preform), foamcore material (e.g., polystyrene foam clad, balsa core, polyethylene foam). Foam, in particular, allows for the inserts 200 to be manufactured with greater consistency than other materials. This benefit is especially noted where, as discussed further below, the inserts 200 are sized to fit within the entire space defined by the angled features 110. Such a fit would require more precision in manufacturing the inserts 200 as the inserts 200 would have to be measured to match the angled features 110. The use of a foam insert 200 may provide for faster installation and more consistent placement for purposes of supporting a later installed reinforcement material, such as an overlaying member. However, in other embodiments, the inserts 200 may be made of various other materials having similar strength and weight characteristics, such as other metals, plastics, or woods, as would be appreciated by one skilled in the art.

Although FIG. 3 depicts the surfaces 201,202 of the insert 200 as being smaller than the treads 111 and risers 112, in other embodiments, the edges of at least some of the insert 200 may be substantially the same length as at least some of the treads 111 and/or may be substantially the same height as the risers 112. In such an example, the inserts 200 may occupy substantially the entire space of the angled feature 110 so that no backfill is required to fill the space of the angled features 110. Further, in other embodiments, there may be no inserts 200 such that nothing is between the space 113 of the angled feature 110 and the cover 600.

After the inserts 200 are applied, another layer of reinforcement spray 400 may be applied over the inserts 200 to aid in securing the inserts 200 and to provide further support to the angled features 110. This reinforcement spray 400 may additionally provide an adhesive surface for other reinforcement components to adhere to. For example, in certain embodiments, a cover 600 may be applied on the reinforcement spray 400 (in a wet or dry form) over the inserts 200 before moving on to the attachment of other reinforcement components.

Figure 6:
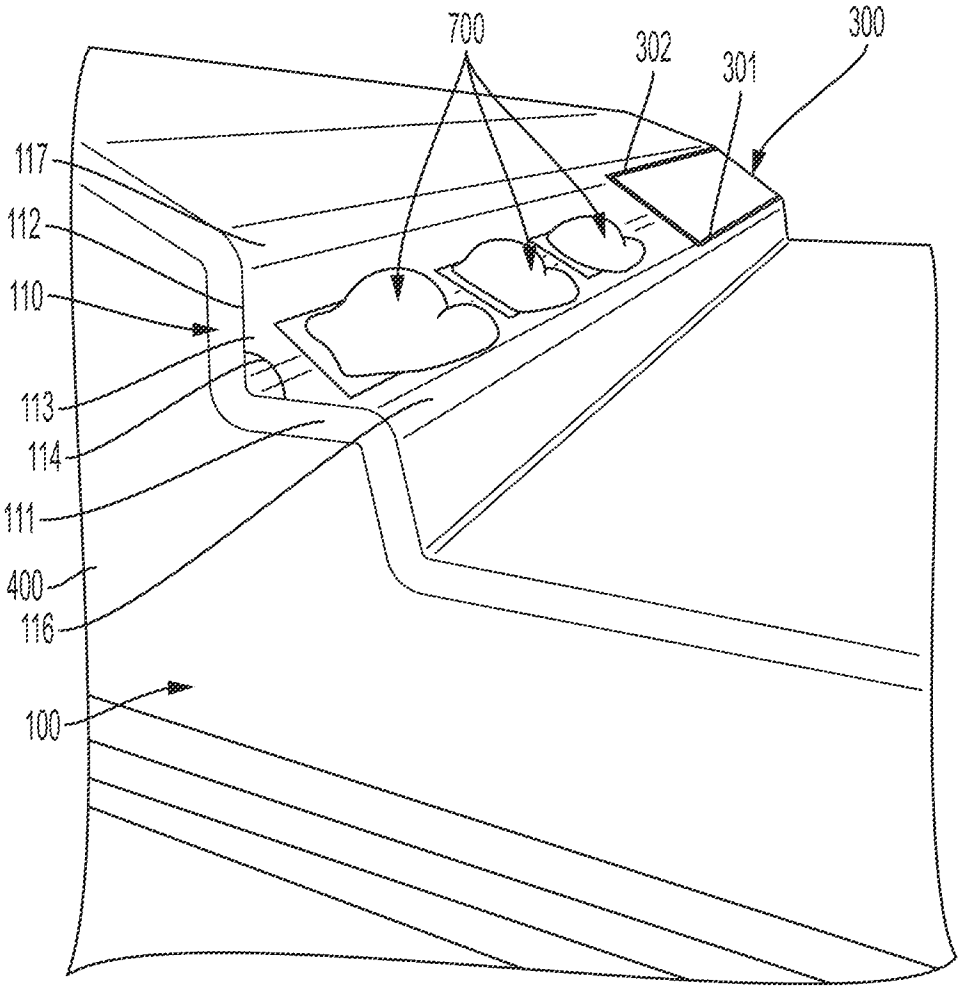
FIG. 6 is an upper perspective view of overlaying members being installed on the projections of the pool shell body of FIG. 5.

FIG. 3 depicts an embodiment in which a cover 600 may be overlaid on the ramp surface 203 of the inserts 200. In some embodiments, no insert 200 is provided and instead the cover 600 is positioned as shown in FIG. 3 without an insert 200 provided between the cover 600 and the pool shell body 100. The cover 600 may provide additional strength to the angled features 110 and provide additional protection to the inserts 200. The cover 600 may include ends 601,602 attached to the angled feature 110. In particular, a bottom (or first) end 601 may be attached to the tread 111 and a top (or second) end 602 may be attached to the riser 112. Although the ends 601,602 are shown being attached to the angled feature 110 along an intermediate portion of the tread 111 and riser 112, in other embodiments, the ends 601,602 may be attached to the distal-most edge of the tread 111 and riser 112 (e.g., as shown in FIG. 6, the edge 117 of the riser 112 and the edge 116 of the tread 111). In this example, the cover 600 may extend over the entirety of the space defined by the angled feature 110. Further, although a single cover 600 is shown attached over a single angled feature 110, in other embodiments, there may be a single cover 600 that covers all the angled features 110. In such an example, this single cover 600 may extend from a top edge of the top angled features 110 to a bottom edge of the bottom angled features 110 such that all the angled features 110 are covered by a single cover 600.

The cover 600 may be a fabric material. For example, the cover 600 may be a fiberglass cloth, such as woven roving. For example, this may be a 2415 or 1708 combo mat. The cover 600 may include chopped strands of fiberglass. The cover 600 may additionally or alternatively be made of carbon Kevlar, vinyl esters, urethane adhesive, resin epoxy, or the like. The cover 600 may be attached to the pool shell using a fiberglass roller (e.g., a rib roller) to remove air bubbles and provide a smooth finish when applied over the insert 200. The cover 600 may be further covered with a reinforcement spray 400, such as a resin (or resin and fiberglass chop mix), as discussed previously, to attach and secure the cover 600 to the reinforcement components below the cover 600.

Figure 4:
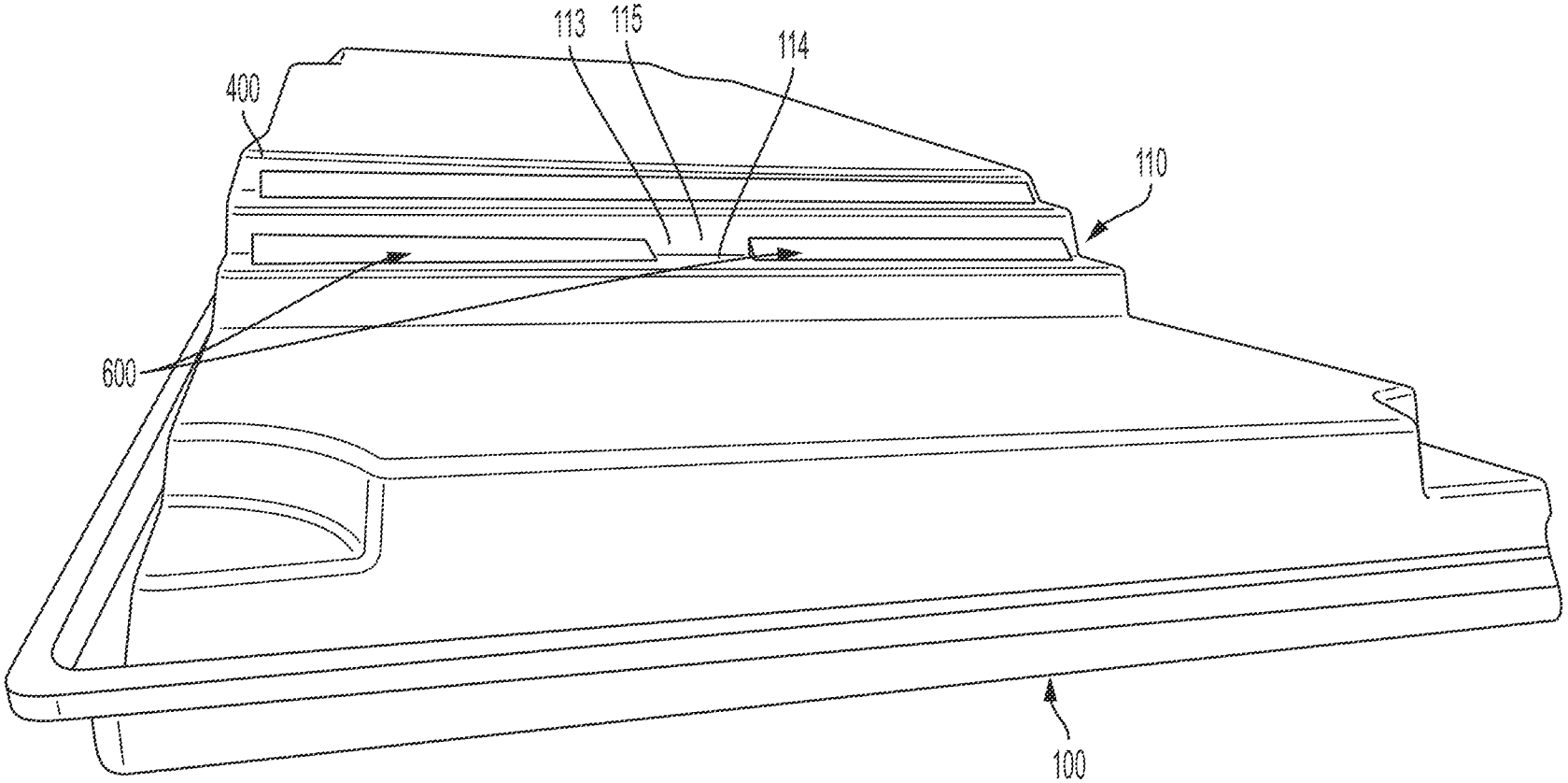
FIG. 4 is a front perspective view of the of the underside of the pool shell body of FIG. 3.

Turning to FIG. 4, an underside of the pool shell body 100 is depicted after the application of the inserts 200 and the cover(s) 600. As shown in FIG. 4, in some embodiments, the inserts 200 and the covers 600 may be positioned such that the inserts 200 and covers 600 may define a gap 115 therebetween. This gap 115 may allow, for example, access to areas of the pool shell 100 within the space 113 for ease of installation of various internal features of a pool, including lights, bubblers, jets, and the like. Although FIG. 4 depicts only one gap 115, in other embodiments, there may be more or fewer gaps 115 depending on the number of inserts 200 and/or layers positioned along the width of the angled feature 110. In other embodiments, there are no gaps 115, and the inserts 200 and covers 600 have a width running the entire length of the angled features 110.

Figure 5:
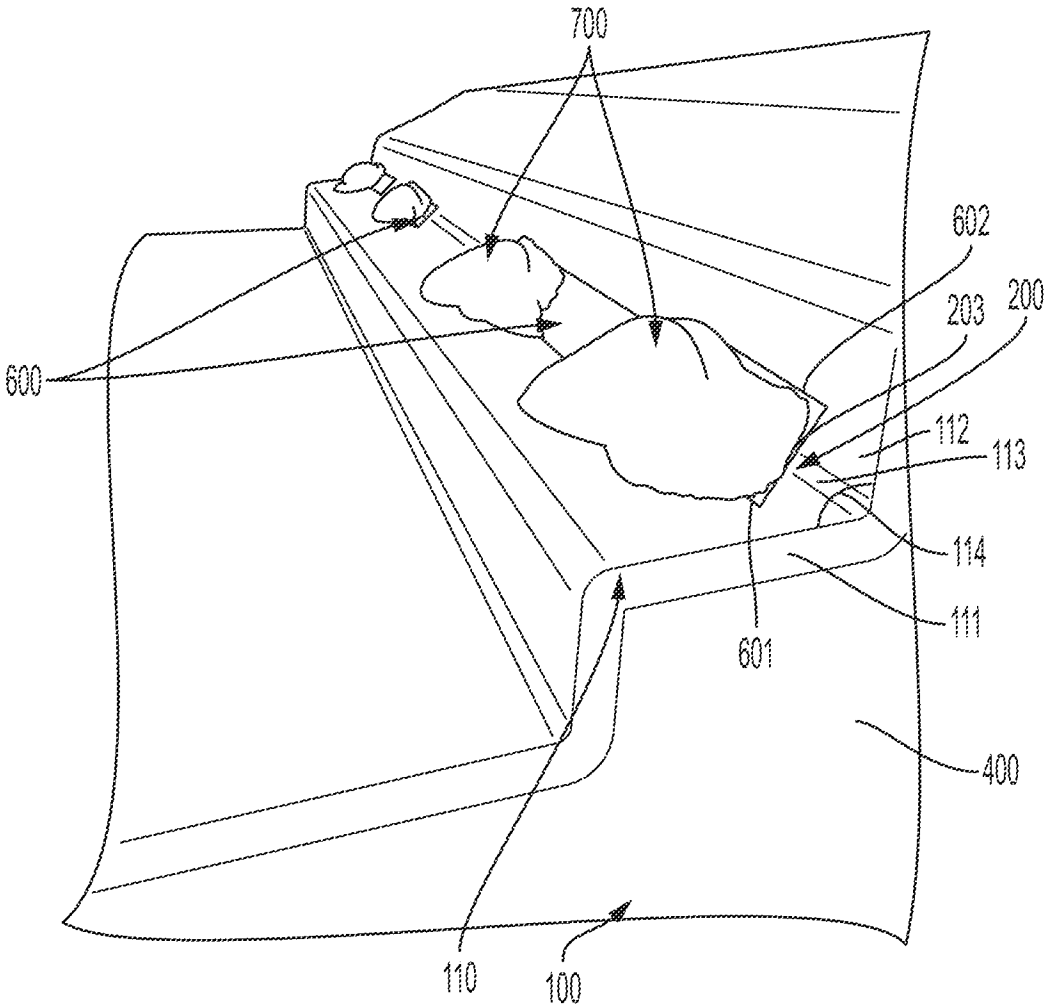
FIG. 5 is a side perspective view of projections being installed on the inserts and covers of the pool shell body of FIGS. 3 and 4.

Turning to FIG. 5, a plurality of projections 700 may be installed on top of the inserts covers 600. These projections 700 may be shaped to at least partially fill the remaining space 113 defined by the angled features 110. The projections 700 may also provide additional structural support for other reinforcement components (e.g., the overlaying members 300, as discussed further below) while providing a reduced weight and material usage (for cost purposes). For example, the projections 700 may be a bulbous shape such that the most exterior-facing portions of the projections 709 provide additional support for other reinforcement components while filling the space 113. The projections 700 may be dimensioned, for example, to be several inches in height. For example, the height of the projections 700 may be, but are not limited to, between about 3 inches and about 6 inches, between about 2 inches and about 7 inches, or about 5 inches. The size and shape of the projections may be selected based on the size and shape of the open regions defined by the angled features 110 of the pool shell body 100. The projections 700 may extend along the length of the cover 600, which may be shorter than or substantially the same length as the angled feature 110 (e.g., the width of a stair). In a further alternative, one or more projections 700 may be attached to at least one of the treads 111 or risers 112 without the projections 700 being attached to the covers 600. In a yet further alternative, the projection 700 may extend over the entirety of the space defined by the angled feature 110 along the width of the projection 700 such that the ends of the projection 700 are attached to the distal-most ends of the tread 111 and riser 112.

The projections 700 may be generally equally spaced apart across the length of the insert and covers 600. For example, the projections 700 may be spaced apart by 1 foot or 2 feet, or any suitable distance. In some embodiments, the projections 700 are not equally spaced apart. In some embodiments, only a single projection 700 may be included. For example, the single projection 700 may be one uniform mass of material spanning at least a portion of the length of the angled feature 110.

The projections 700 may be made of various materials, including being made of a spray material such as a resin and/or chopped fiberglass, as previously discussed. In other aspects, the projections 700 may be made from a foam material, such as high-density foam, which may be cut or otherwise dimensioned to fit within the open regions defined by the angled features 110. In still yet other aspects, the projections 700 may comprise fiberglass composite materials, high-density foamcore, plasticore, finolex, urethane foam, or carbon fiber may be used. In various aspects, the overlaying members may be made from other materials, including wood (such as plywood), various plastics or polymers, or metal (such as aluminum sheeting).

Turning to FIG. 6, one or more overlaying members 300 may be placed over the one or more of projections 700, such that the projections 700 provide a contact point along an interior surface of the overlaying members 300 facing the space 113 to support the stiffener components 500. Though, in some aspects, the projections 700 do not touch the underside of the overlaying members 300.

The overlaying members 300 may include a top (or first) edge 301 and a bottom (or second) edge 302. The overlaying members 300 may be positioned such that the bottom edge 301 is attached to a bottom (or first) edge 116 of the tread 111 and the top edge 302 is attached to a top (or second) edge 117 of the riser 112. The edges 301,302 may be shaped (e.g., beveled or tapered) such that the edges 301,302 may correspondingly lay flush/aligned against the tread 111 and riser 112. In this manner, the overlaying members 300 may extend from the bottom edge 301 to the top edge 302, and cover the space 113 and interior angle 114 of the angled feature 110. With this configuration, the overlaying members 300 may match the hypotenuse edge of the interior angle 114 (i.e., the hypotenuse between the edges 116,117).

By positioning the overlaying members 300 to extend from the bottom edge 116 to the top edge 117 of the angled feature 110, there is no need to backfill the space 113 defined by the angled feature 110. In other words, the overlaying members 300 define an exterior surface that covers the space 113 such that there is no longer an empty space defined by the angled feature 110 that would require backfilling during installation of the pool shell 100. The overlaying members 300 may, in turn, be supported by the reinforcement components beneath the overlaying members 300 (e.g., the projections 700, the cover 600, the stiffener components 500, and the inserts 200) to aid in retaining and supporting the overlaying members 300.

One or more overlaying members 300 may extend along a length of the angled feature 110 sought to be covered for reducing backfill requirements. In some embodiments, one or more of the overlaying members 300 may attach to an intermediate portion of the tread 111 and riser 112 such that the overlaying members 300 do not extend from the bottom and top edges of the treads 111/risers 112 such that the overlaying members 300 do not fully enclose the open region defined by the angled feature 110. Such a configuration may be beneficial, for example, to accommodate a particular ground shape. The one or more overlaying members 300 may be made from a planar structure of various materials, including those discussed above for the stiffener components 500, including but not limited to fiberglass composite materials, high-density foamcore, plasticore, finolex, urethane foam, or carbon fiber may be used. In various aspects, the overlaying members may be made from other materials, including wood (such as plywood), various plastics or polymers, or metal (such as aluminum sheeting).

In various implementations, the overlaying members 300 may be covered with a reinforcement spray 400, which may comprise resin and/or chopped fiberglass. The overlaying members 300 may also be covered with a fabric material, similar to or the same as the fabric material discussed above for the cover 600. This cover may further be rolled out with a fiberglass roller, as discussed above. This cover may aid in securing the overlaying members 300 to the pool shell 100 and to provide additional strength. After the cover is laid down, additional reinforcement spray 400 may be added on top of the cover to additionally protect the pool shell from damage from shifting soil, weather damage, root damage, and the like.

Figure 7:
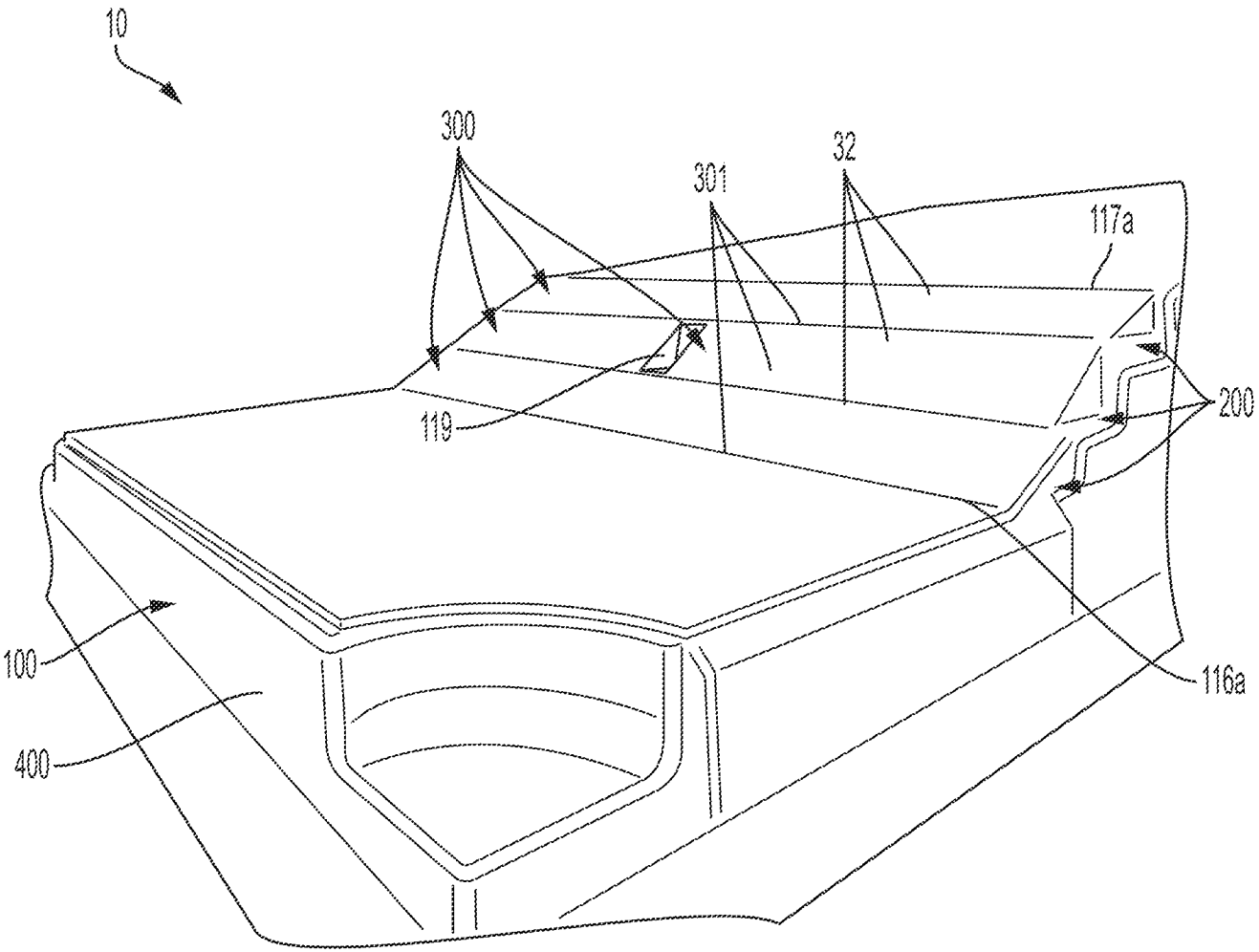
FIG. 7 is an upper perspective view of an underside of a completed pool shell including reinforcement components according to certain embodiments of the present disclosure.

FIG. 7 depicts the completed pool shell 10 with the underside defined in part by the overlaying members 300 covered in reinforcement spray 400. In some aspects, the overlaying members 300, and other reinforcement elements, may be installed such that a gap 119 is defined. The gap 119 may be provided to allow for ease of installation of pool features, including lights, bubblers, jets, or the like, as was discussed above with regards to the gap 115 shown in FIG. 4. In other embodiments, there may be more than one gap 119, such as two, three, four, or the like. In other embodiments, there are no gaps 119.

As shown in FIG. 7, where multiple angled features 110 are provided adjacent one another, the overlaying members 300 may be positioned relative to the various edges 301,302 of each other to define together a substantially consistent angle from a top-most edge 117*a* to a bottom-most edge 116*a* of the angled features 110 being covered by the overlaying members 300. In this manner, a substantially planar surface is formed by the various overlaying members 300 being aligned with each other. As a result, there is less (or no) need to backfill the entirety of the spaces 113 defined by the angled features 110 (as shown in FIGS. 2 and 3) due to the presence of the overlaying members 300. In this way, installation of the pool shell 10 may be easier, faster, cheaper, safer, and may be completed with less skilled labor. Additionally, this may result in a pool installation that is less likely to crack or deform than an installation performed through traditional backfill methods. In other words, the reinforcement components have been used to fill the spaces defined by the angled features 110 (here shown as steps) and moreover the reinforcement components may be positioned to provide for a consistent sloped angle between the angled features. The filled regions and the substantially consistent sloped angle thus reduces the need for backfilling and may make the process easier with a lesser chance of backfilling errors.

The lateral ends of the angled features 110 may have one or more reinforcement components covering the lateral ends. For example, the lateral ends may be covered only with a reinforcement spray 400, a cover material (e.g., cover 600), or other reinforcement components.

However, other arrangements are contemplated by the present disclosure. For example, rather than the overlaying members 300 defining a substantially planar surface, in some aspects, the overlaying members 300 may be angled such that the angle of adjacent overlaying members 300 may vary. Additionally, although the embodiments described above include the use of a number of reinforcement components (e.g., the insert 200, the covers 600, the stiffener components 500, the projections 700, and the overlaying members 300), in other embodiments, a pool shell 10 may include more or fewer reinforcement components.

For example, in another embodiment of the present disclosure, FIGS. 8-12, shows an embodiment of the assembly of a pool shell 20 similar to the pool shell 10. It is understood that features ending in like reference numerals as features discussed above are similar, except as noted below. In this embodiment, after the application of the stiffener components (as shown in FIG. 2), on the risers 1112 and treads 1111, a reinforcement spray 1400 may be applied and thereafter one or more covers (not shown), similar to cover 600, may be applied on top of the reinforcement spray 1400 (wet or dry) and stiffener components 1500. The covers may be positioned over the stiffener components and the corresponding angled features 1110. The covers may have little to no gap between the covers, and the stiffener components and angled features 1110. The covers may provide structural support to the angled features 1110 while also helping to further secure the stiffener components to the angled features 1110. A reinforcement spray 1400 may be applied over the covers to help secure the covers to the angled features 1110, as discussed above.

In other embodiments there may be more than one cover corresponding to each angled feature 1110 depending on the size of the cover in relation to the size of the angled feature 1110. For example, there may be a cover occupying a corner of the angled features 1110 (e.g., a portion of the angled features 1110 where the treads 1111 and risers 1112 meet). In some embodiments, there may be one cover for each tread 1111/riser 1112 of the angled feature 1110. In yet other embodiments, there may be multiple covers for each tread 1111/riser 1112. In a further alternative, there may be a cover sized to match the size of the angled feature 1110 such that there is one cover per angled feature 1110. In a yet further embodiment, there may be a single cover that drapes over all the angled features 1110 and stiffener components. In further embodiments, there may be no cover overlaying the stiffener components and, instead, other reinforcement components may lay over the stiffener components.

Figure 8:
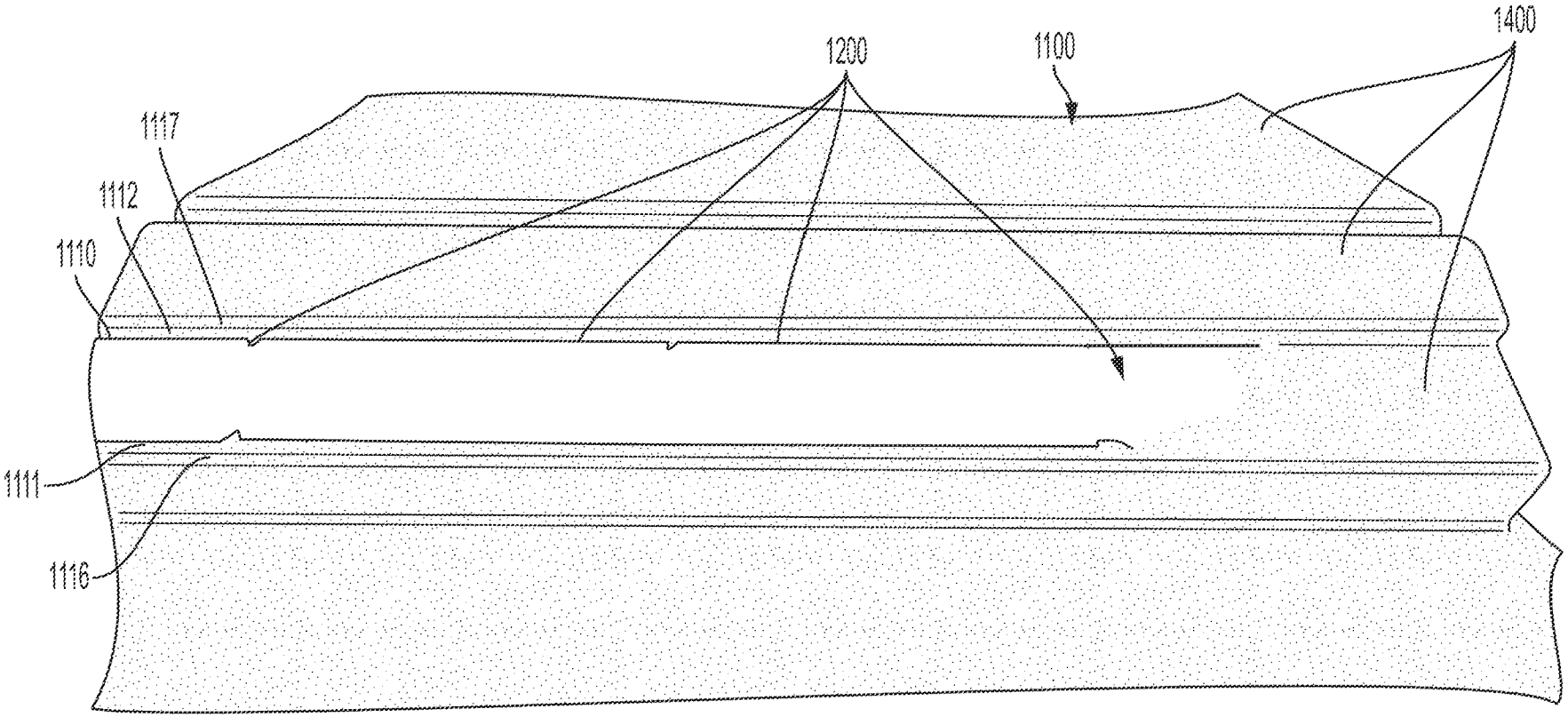
FIG. 8 is a front perspective view of inserts being installed on a pool shell body according to certain embodiments of the disclosure.

Turning to FIG. 8, once the cover is adhered over the stiffener components (or after positioning of the stiffener components if no cover is used), an additional reinforcement spray 1400 may be applied over the cover. Thereafter one or more inserts 1200 may be positioned on top of the reinforcement spray 1400 (wet or dry) in the open region defined by the angled features 1110. In some embodiments, the one or more inserts 1200 may have a shape generally corresponding to the shape of the open region, though in other embodiments the inserts 1200 may have a different shape. As shown in the embodiment depicted in FIG. 8, for example, the inserts 1200 may be generally triangular prismoid in shape and may be positioned in the open region defined by adjacent risers 1112 and treads 1111. The inserts 1200 may comprise a foam material (e.g., a foamcore material, such as polystyrene foam clad, balsa core, polyethylene foam, or the like), though other suitable materials may be used in other embodiments (e.g., plastic, polymer, wood, fiberglass, or the like), similar to the materials described above for inserts 200. A foam material may provide for a consistent filler material for the open regions as compared to other materials, such as an application of a heaps or mounds of resin and chop (e.g., projections 700). A foam material may provide a consistent rigid structure of a reliable size and may not deform or consolidate under an application of pressure. Moreover, a foam material or other unitary material/piece for the inserts 1200 may provide for faster installation. The material selected for the inserts 1200 when a rigid structure may also provide for a desired backfill slope corresponding to the filled angled features 1110 prior to positioning of an overlaying member (if an overlaying member is utilized). The inserts 1200 comprising a unitary structure, such as a foam material, can provide a consistent underlying structure and a relatively straight slope along the angled features 1110.

The inserts 1200 may extend nearly to edges 1116,1117 of the adjacent tread 1111 and riser 1112, such that the inserts 1200 substantially fills the open region defined between the tread 1111 and riser 1112. In some embodiments, the insert 1200 may therefore be sized and shaped to substantially fill an open region defined by the angled feature 1110, though in other embodiments, the insert 1200 may not substantially fill the open region. A reinforcement spray 1400 (shown in a stippling pattern for clarity in FIGS. 8-10) may be sprayed over the inserts 1200 to aid in securing the inserts 1200 in position. The reinforcement spray 1400 may comprise a resin and/or chop fiberglass or other suitable material.

Although FIG. 8 depicts multiple inserts 1200 sequentially received end to end within the angled feature 1110, in other embodiments, there may be only one insert 1200 received within the angled feature 1110. For example, there may be one monolithic insert 1200 received along the length of the angled feature 1110.

Figure 9:
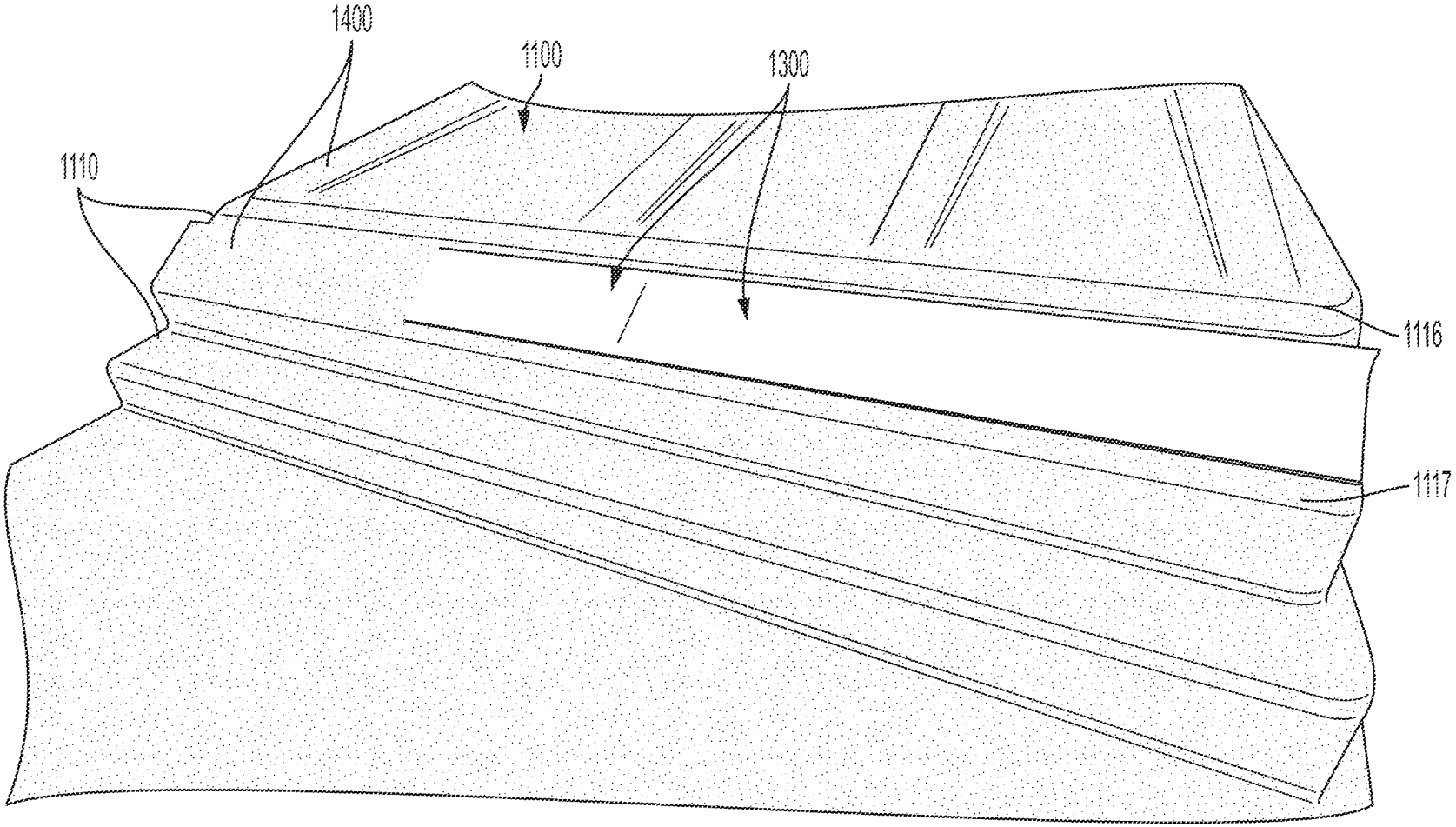
FIG. 9 is a front perspective view of overlaying members being installed on the pool shell body of FIG. 8.

Next, as shown in FIG. 9 one or more overlaying members 1300 may be positioned over the inserts 1200 and pressed into the reinforcement spray 1400 (wet or dry) (if used) for adhering the overlaying member 1300 in position. The overlaying members 1300 may also aid in providing a consistent slope between adjacent edges 1116,1117 of the angled feature 1110. The overlaying members 1300 may comprise similar materials as described above for the stiffener components 500 (e.g., fiberglass composite materials, high-density foamcore, plasticore, finolex, urethane foam, carbon fiber, wood, plastics, polymers, or metals). The overlaying members 1300 may be secured in place by applying another layer of reinforcement spray 1400, as described above, or in other suitable manners.

Although FIG. 9 depicts multiple overlaying members 1300 sequentially received end to end within the angled feature 1110, in other embodiments, there may be only one overlaying member 1300 received within the angled feature 1110. For example, there may be one monolithic overlaying member 1300 received along the length of the angled feature 1110.

Figure 10:
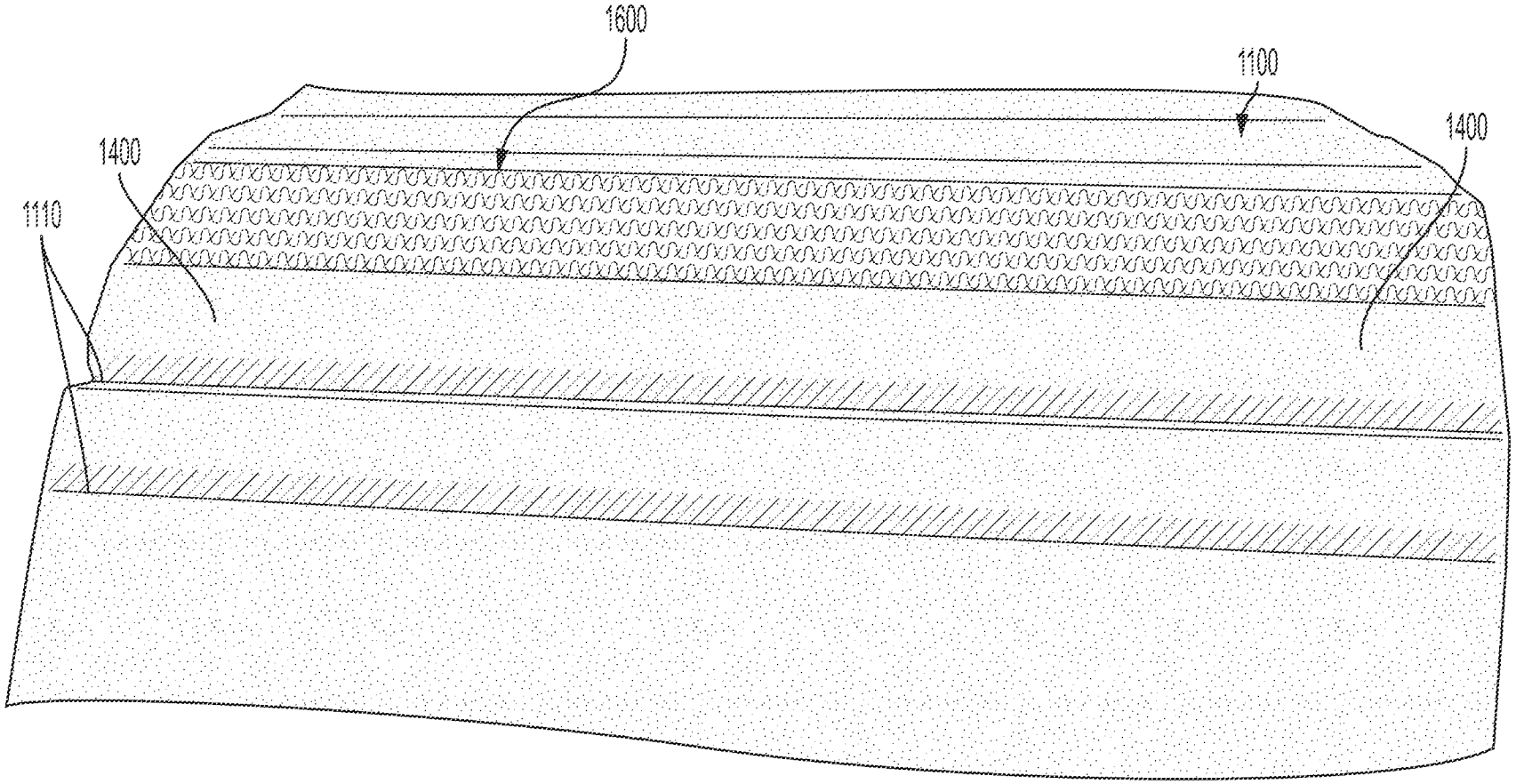
FIG. 10 is a front perspective view of a cover being installed on the pool shell body of FIG. 9.

As shown in FIG. 10, a cover 1600 may then be positioned over the reinforcement spray 1400 applied on top of at least a portion of the overlaying member 1300. The cover 1600 may provide additional strength to the angled features 1110 and provide additional protection to the reinforcement components the cover 1600 lays on top of (e.g., the inserts 1200 and the overlaying members 1300).

Although FIG. 10 shows a single cover 1600 fully covering the top angled feature 1110, in other embodiments, there may be multiple covers 1600 sequentially placed adjacent each other to cover an angled feature 1110. Further, in other embodiments, a single cover 1600 may cover multiple angled features 1110.

Figure 11:
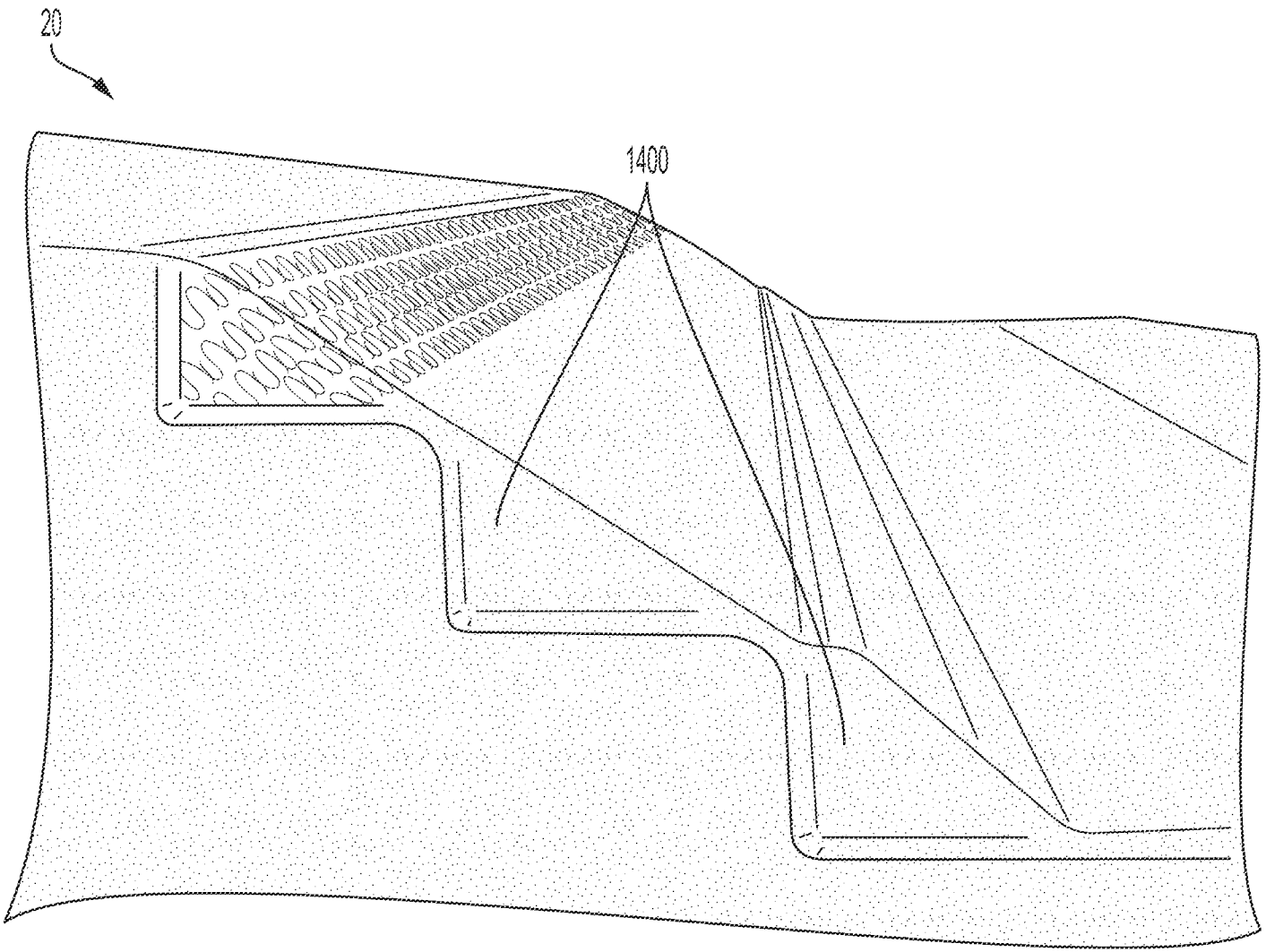
FIG. 11 is a side perspective view of the pool shell body of FIG. 10 according to certain embodiments of the present disclosure.
Figure 12:
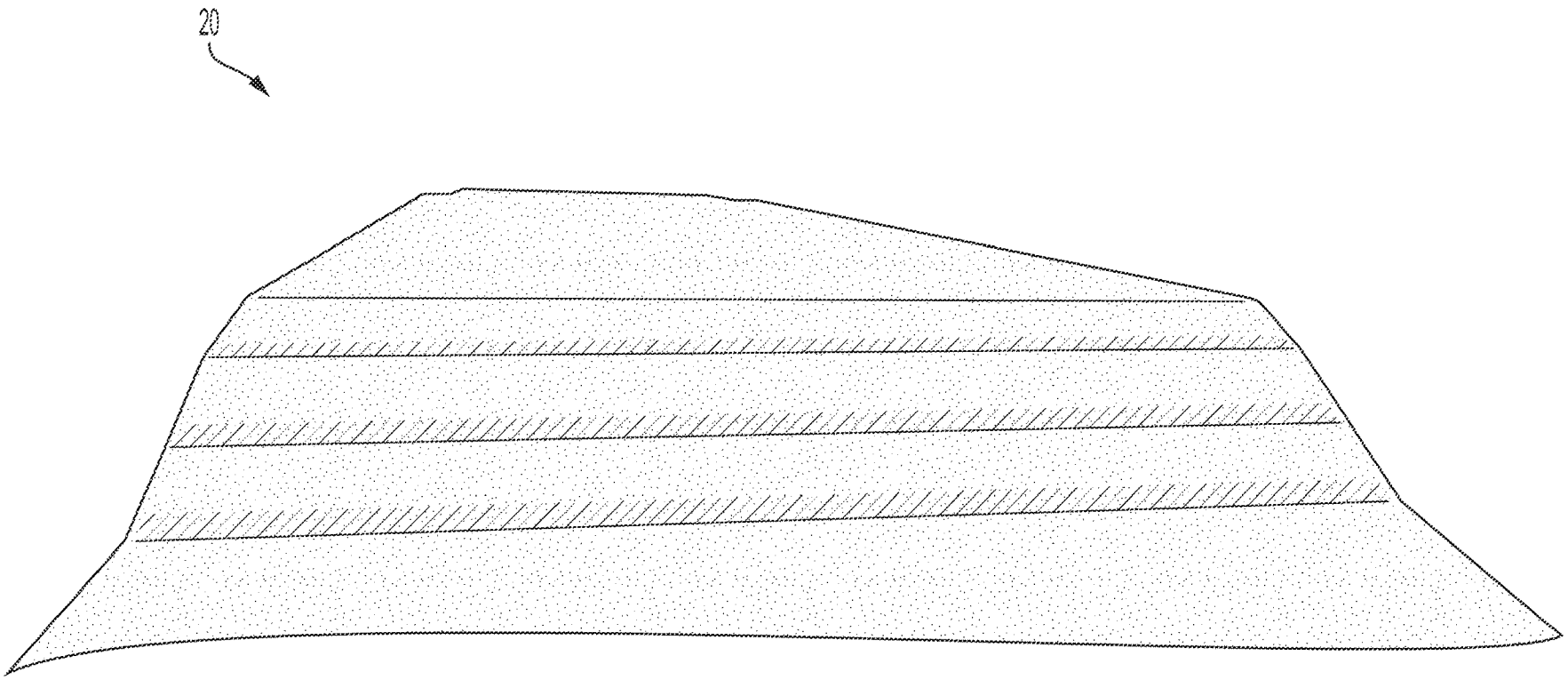
FIG. 12 is a front perspective view of a completed pool shell according to certain embodiments of the present disclosure.

As shown in FIGS. 11-12, the cover 1600 may extend over the ends of the angled feature 110 so as to cover the opening defined by the adjacent angled features 1110 and the overlaying members 1300. Once the cover 1600 is laid over the angled features 1110, a reinforcement spray 1400 (shown in stippling for clarity in FIGS. 11-12) may be applied over the cover 1600 to form the complete pool shell 20. In some embodiments, this final reinforcement spray 1400 may be a resin-only spray. However, in other embodiments, this reinforcement spray 1400 may be a resin and fiberglass chop mix. In some aspects, no final reinforcement spray may be used. As shown in FIG. 11, this reinforcement spray 1400 may additionally be applied over the sides of the angled features 1110 to cover the lateral edges of the angled features 1110 such that no portion of the open region defined by the angled features 1110 are exposed. In other embodiments, one or more of the reinforcement components, as discussed above, may cover the lateral edges of the angled features 1110 before the reinforcement spray 1400 is applied. Alternatively, there me no reinforcement spray 1400 applied along the lateral edges of the angled features 1110.

The present disclosure contemplates a pool shell having reinforcement elements that may include fewer elements and/or fewer steps than those described above. For example, one or more applications of a reinforcement spray may not be utilized. In other words, not every step described above is contemplated as being necessary to adhere to the concept of the present disclosure. The resulting pool shell 20, as depicted in FIGS. 11-12 may have a substantially planar or consistent sloped angle extending across the various angled features 1110 such that the backfilling behind those angled features 1110 is much reduced and simplified.

Although FIG. 12 depicts the pool shell 20 as having no gaps, in other embodiments, there may be one or more gaps for installation of various components, similar to gap 119, as described above.

Figure 13:
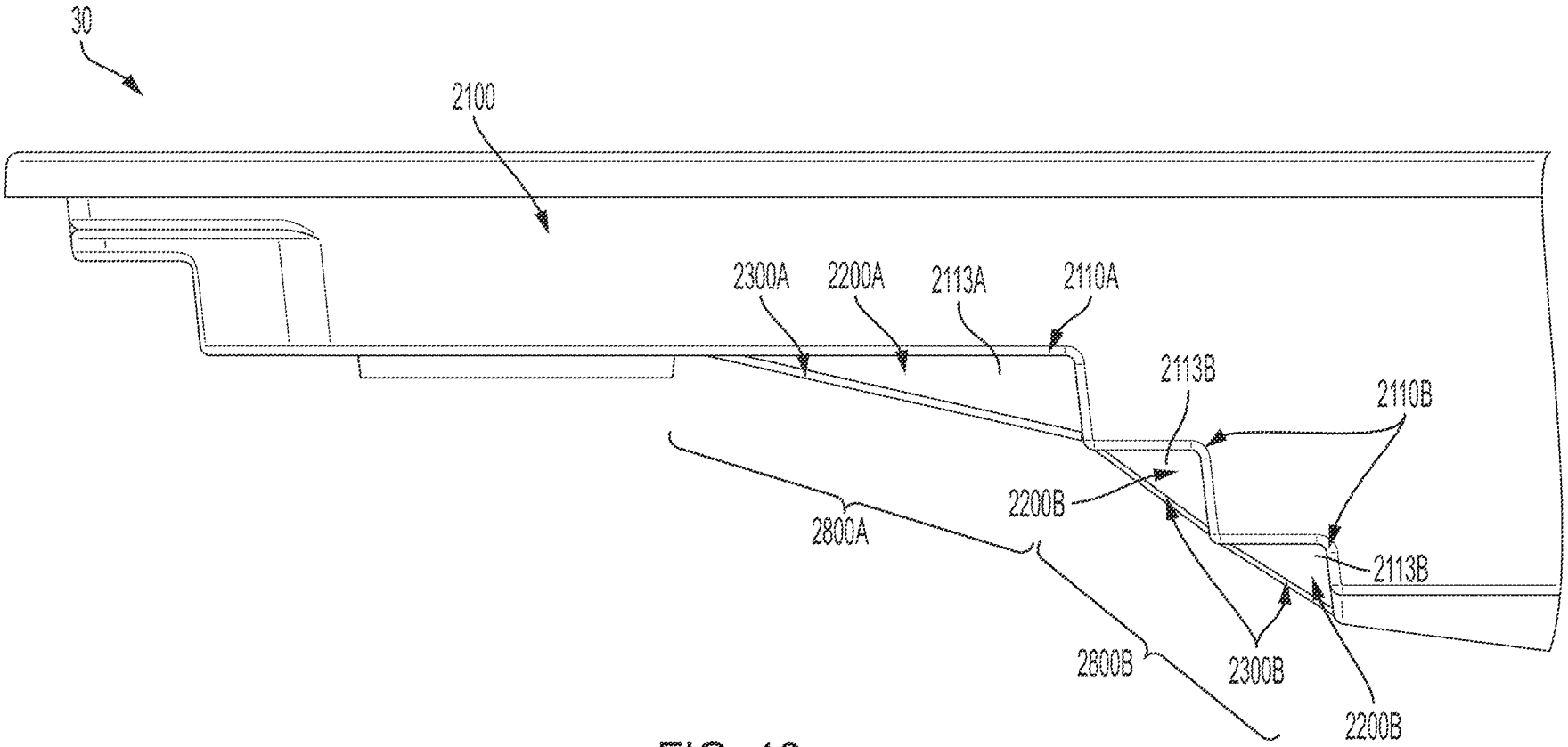
FIG. 13 is a schematic side view of a pool shell including reinforcement components according to certain embodiments of the present disclosure.

In another example, FIG. 13 shows an embodiment of a pool shell 30 similar to the pool shells 10,20. It is understood that features ending in like reference numerals as features discussed above are similar, except as noted below. The pool shell 30 may include two groups 2800A,B of angled features 2110A,B correspondingly defining spaces 2113A,B. Each of the groups 2800A,B may include a number of reinforcement components. For example, the group 2800A may include an insert 2200A and stiffener component (as shown in FIG. 2). seated within the space 2113A of the one angled feature 2110A. The group 2800B may include multiple inserts 2200B and overlaying members 2300B seated within the spaces 2113B of the two angled features 2110B. The overlaying members 2300B and inserts 2200B may be dimensioned and positioned such that each of the overlaying members 2300B and inserts 2200B are linearly aligned with one another.

While the overlaying members 2300A,B each provide substantially planar surfaces, the overlaying member 2300A may be transverse to the overlaying members 2300B. In this manner, the angle defined between the overlaying member 2300A and the overlaying members 2300B may better correspond to a feature of the ground the pool shell 30 is intended to be installed in. This configuration, therefore, allows for the pool shell 30 to be installed within a hole dug for receiving the pool shell 30 corresponding to the angle between the two groups.

In other embodiments, there may be more than two groups 2800A,B of angled features 2110A,B, such as three, four, or the like. In yet further embodiments, there may be more than two angled features 2110A,B per group 2800A,B, such as three, four, or the like. In other aspects, a single overlaying member 2300A may span two or more of the plurality of angled features 2110A,B to provide a substantially planar surface between these multiple angled features 2110A,B. This may allow for further ease of manufacturing the pool shell 30 by having to individually install less reinforcement components.

Since the pool shell 30 is depicted as including only the inserts 2200 A,B and overlaying members 2300 A,B of the reinforcement components, material and labor costs may be during manufacture of the pool shell 30 as there is less reinforcement components required for installation. In other embodiments, there may be more reinforcement components. For example, in other embodiments, the pool shell 30 may include additional stiffener components, covers, and reinforcement sprays, as described above.

Figure 14:
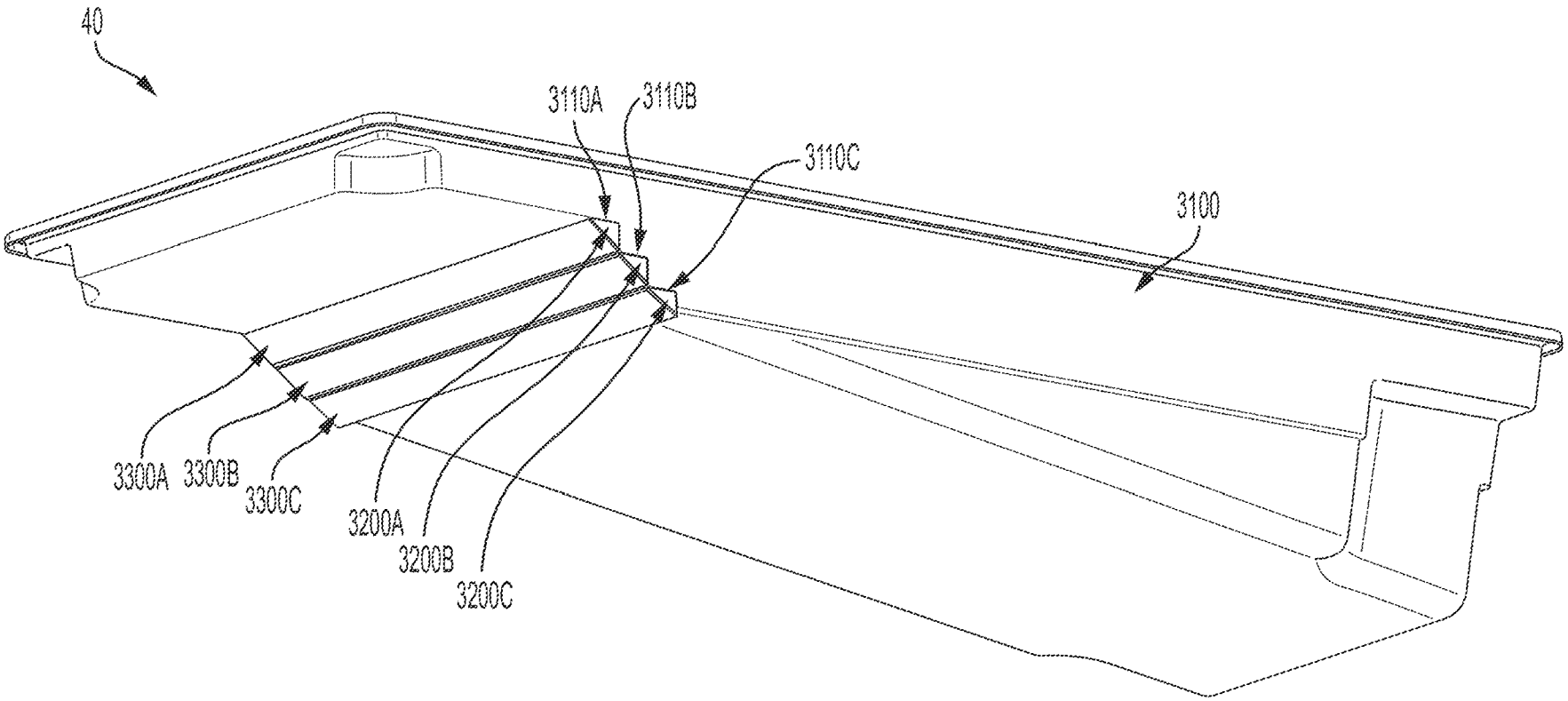
FIG. 14 is a schematic lower perspective view of a pool shell including reinforcement components according to certain embodiments of the present disclosure.
Figure 15:
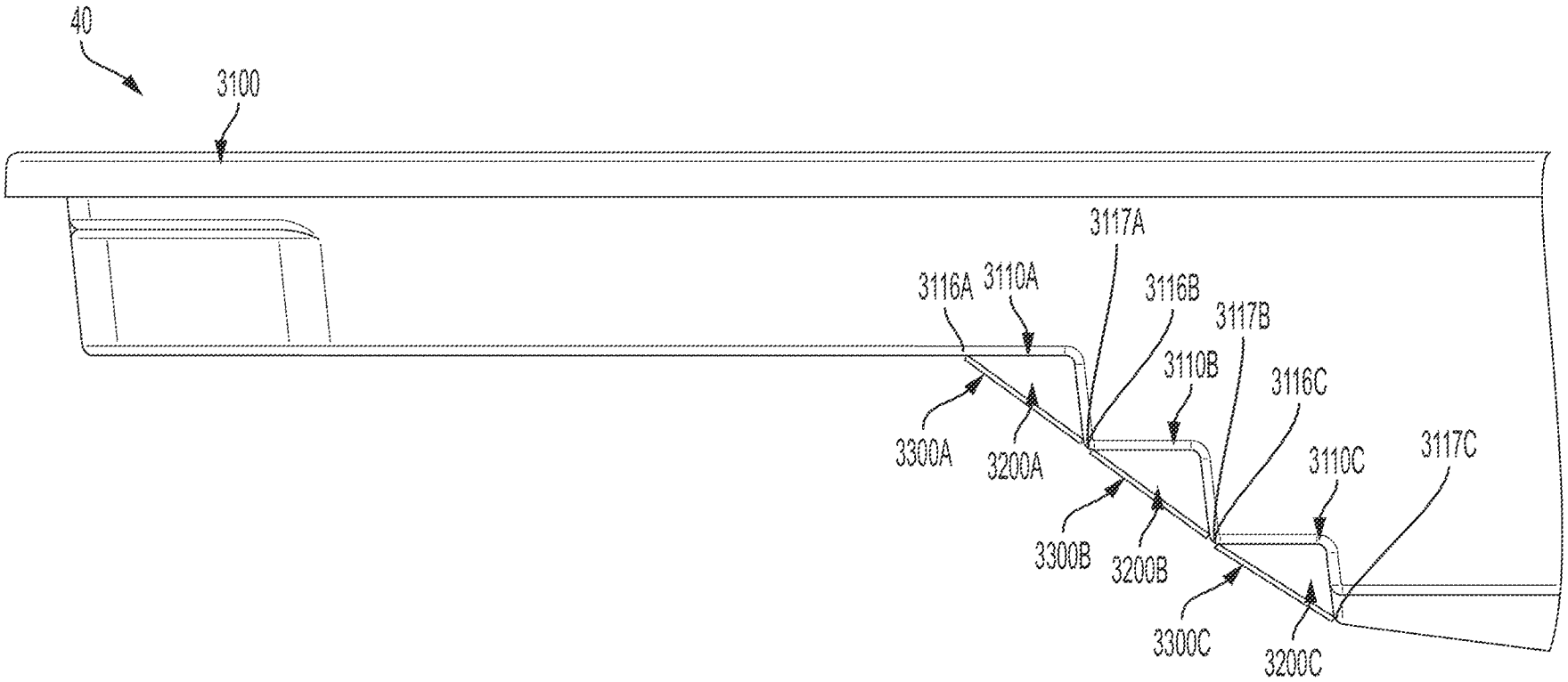
FIG. 15 is a schematic side view of the pool shell of FIG. 14.
Figure 16:
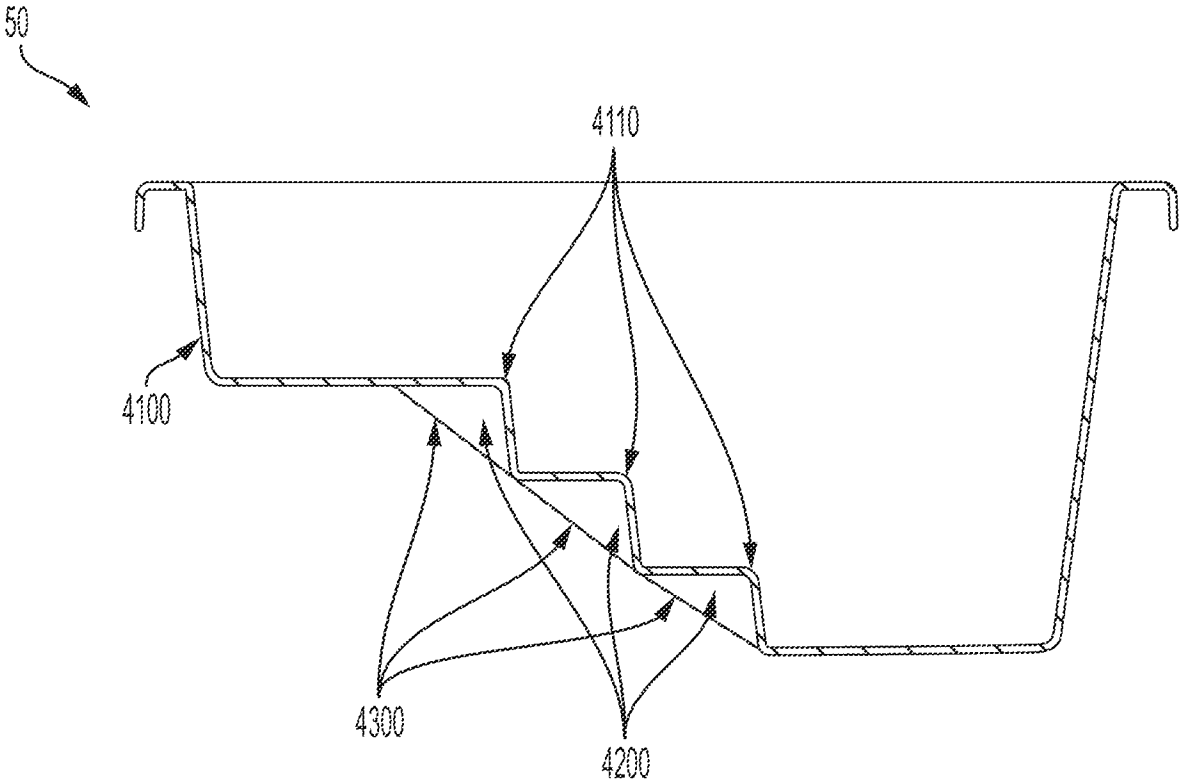
FIG. 16 is a schematic side view of a hot tub shell including reinforcement components according to certain embodiments of the present disclosure.

FIGS. 14-15 show an embodiment of a pool shell 40 similar to the pool shells 10,20,30. It is understood that features ending in like reference numerals as features discussed above are similar, except as noted below. Specifically, the inserts 3200A,B,C may have substantially similar dimensions to each other such that the overlaying members 3300A,B,C are aligned to form a substantially planar surface having a generally consistent slope. The inserts 3200A,B,C completely fill the angled features 3110A,B,C such that the edges of the inserts 3200A,B,C are attached to the edges 3116A,B,C, 3117A,B,C. As noted above, in other embodiments, the pool shell 40 may have other reinforcement components, such as stiffener components, covers, and reinforcement sprays.

FIG. 15 depicts a hot tub shell 50 having similar features to the pool shell 10,20,30,40. It is understood that features ending in like reference numerals as features discussed above are similar, except as noted below. Specifically, the hot tub shell 50 includes a hot tub shell body 4100 with angled features 4110 and at least one reinforcement component received within the angled features 4110 (e.g., inserts 4200 and overlaying members 4300) for filling the open regions defined by the angled features 4110 and for forming a generally planar surface having a generally consistent slope.

While the angled features depicted herein are steps and tanning ledges, it is contemplated that angled features could include safety ledges, benches, and other pool features resulting in open regions on the underside of the pool shell without departing from the scope of the present disclosure. Having disclosed several embodiments, it will be recognized by those of skill in the art that various modifications, alternative constructions, and equivalents may be used without departing from the spirit of the embodiments. Additionally, a number of well-known processes and elements have not been described in order to avoid unnecessarily obscuring the present technology. Accordingly, the above description should not be taken as limiting the scope of the technology. Additionally, methods or processes may be described as sequential or in steps, but it is to be understood that the operations may be performed concurrently, or in different orders than listed.

Where a range of values is provided, it is understood that each intervening value, to the smallest fraction of the unit of the lower limit, unless the context clearly dictates otherwise, between the upper and lower limits of that range is also specifically disclosed. Any narrower range between any stated values or unstated intervening values in a stated range and any other stated or intervening value in that stated range is encompassed. The upper and lower limits of those smaller ranges may independently be included or excluded in the range, and each range where either, neither, or both limits are included in the smaller ranges is also encompassed within the technology, subject to any specifically excluded limit in the stated range. Where the stated range includes one or both of the limits, ranges excluding either or both of those included limits are also included.

As used herein and in the appended claims, the singular forms "a", "an", and "the" include plural references unless the context clearly dictates otherwise. Thus, for example, reference to "a plate" includes a plurality of such plates, and reference to "the aperture" includes reference to one or more apertures and equivalents thereof known to those skilled in the art, and so forth.

Also, the words "comprise(s)", "comprising", "contain(s)", "containing", "include(s)", and "including", when used in this specification and in the following claims, are intended to specify the presence of stated features, integers, components, or operations, but they do not preclude the presence or addition of one or more other features, integers, components, operations, acts, or groups.

The invention claimed is:

1. A pool shell, comprising:

a pool shell body including an angled feature, wherein the angled feature defines an open region on an underside of the pool shell body;

an insert positioned in the open region for providing structural support to the angled feature; and an overlaying member positioned over the open region such that the insert is positioned between the underside of the pool shell body and the overlaying member, wherein the overlaying member is a substantially flat material for defining an exterior ramp surface extending over the open region defined by the angled feature.

2. The pool shell of claim 1, further comprising a stiffener component positioned between the pool shell body and the insert.

3. The pool shell of claim 1, wherein the insert comprises a foam material.

4. The pool shell of claim 1, wherein the overlaying member comprises at least one of a fiberglass composite material, a high-density foamcore material, a urethane foam material, or a carbon fiber material.

5. The pool shell of claim 1, further comprising a reinforcement layer applied between the insert and the overlaying member for aiding in securing the insert to the pool shell body.

6. The pool shell of claim 5, wherein the reinforcement layer comprises a reinforcement spray.

7. The pool shell of claim 6, wherein the reinforcement spray includes a resin material and a fiberglass material.

8. The pool shell of claim 1, wherein:

the angled feature includes a first edge and a second edge; and wherein the overlaying member extends from the first edge of the angled feature to the second edge of the angled feature for enclosing the open region on the underside of the pool shell body defined by the angled feature.

9. The pool shell of claim 8, wherein the angled feature includes a tread and riser and wherein the first edge of the angled feature corresponds to a first end of the tread and the second edge of the angled feature corresponds to a first end of the riser.

10. The pool shell of claim 9, further comprising a cover positioned on an outer surface of the overlaying member.

11. The pool shell of claim 10, wherein the cover is a fabric material.

12. The pool shell of claim 11, wherein the fabric material comprises fiberglass.

13. A method of manufacturing a pool shell comprising the steps of:

providing a fiberglass pool shell having an angled feature defining an open region on an underside of the fiberglass pool shell;

positioning an insert in the open region defined by the angled feature;

positioning an overlaying member over the insert; and applying a reinforcement layer over the overlaying member for securing the overlaying member to the fiberglass pool shell, wherein the overlaying member defines a ramped surface that encloses at least a portion of the open region.

14. The method of claim 13, further comprising:

positioning a stiffener component to at least a portion of the angled feature prior to positioning the insert in the open region defined by the angled feature, wherein the stiffener component comprises a fiberglass material.

15. The method of claim 14, further comprising:

positioning an additional insert in an additional open region on the underside of the fiberglass pool shell defined by an additional angled feature of the fiberglass pool shell.

16. The method of claim 15, wherein the overlaying member covers the open region and the additional open region defined by the angled feature and the additional angled feature of the fiberglass pool shell.

17. The method of claim 15, further comprising:

positioning an additional overlaying member over the additional open region defined by the additional angled feature of the fiberglass pool shell.

18. The method of claim 14, further comprising:

applying a cover over the overlaying member, wherein the cover is a fabric material comprising a fiberglass material.

19. The method of claim 13, further comprising:

applying a second reinforcement layer over the insert for securing the insert in the open region.

20. The method of claim 19, wherein the second reinforcement layer comprises at least one of a resin or a fiberglass material.

* * * * *